US010431885B2

(12) United States Patent
Tseng et al.

(10) Patent No.: US 10,431,885 B2
(45) Date of Patent: Oct. 1, 2019

(54) ANTENNA SYSTEM AND ANTENNA STRUCTURE THEREOF

(71) Applicant: WISTRON NEWEB CORPORATION, Hsinchu (TW)

(72) Inventors: Shih-Hsien Tseng, Hsinchu (TW); Chih-Ming Wang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 15/689,228

(22) Filed: Aug. 29, 2017

(65) Prior Publication Data

US 2018/0083353 A1 Mar. 22, 2018

(30) Foreign Application Priority Data

Sep. 19, 2016 (TW) ..... 105130164 A
Apr. 26, 2017 (TW) ..... 106113968 A

(51) Int. Cl.

| | |
|---|---|
| ***H01Q 5/00*** | (2015.01) |
| ***H01Q 1/42*** | (2006.01) |
| ***H01Q 5/364*** | (2015.01) |
| ***H01Q 1/24*** | (2006.01) |
| *H01Q 5/392* | (2015.01) |

(Continued)

(52) U.S. Cl.

CPC ..... *H01Q 1/422* (2013.01); *H01Q 1/245* (2013.01); *H01Q 5/364* (2015.01); *H01Q 1/243* (2013.01); *H01Q 5/328* (2015.01); *H01Q 5/371* (2015.01); *H01Q 5/392* (2015.01)

(58) Field of Classification Search

CPC ..... H01Q 1/243; H01Q 1/38; H01Q 9/42; H01Q 5/371; H01Q 21/30; H01Q 5/328
USPC ..... 343/700 MS, 702, 845, 846
See application file for complete search history.

(56) References Cited

U.S. PATENT DOCUMENTS 7,425,924 B2 * 9/2008 Chung ..... H01Q 1/38 343/702
7,868,838 B2 * 1/2011 Tai ..... H01Q 1/2266 343/729

(Continued)

FOREIGN PATENT DOCUMENTS

CN 103259076 A 8/2013
CN 103516839 A 1/2014

(Continued)

*Primary Examiner* — Linh V Nguyen
(74) *Attorney, Agent, or Firm* — Li & Cai Intellectual Property (USA) Office

(57) ABSTRACT

The instant disclosure provides an antenna system and an antenna structure thereof. The antenna structure includes a substrate, a radiation element, a coupling element, a grounding element, a conducting element, and a feeding element. The radiation element is disposed on the substrate and includes a first radiation portion for providing a first operating band, a second radiation portion for providing a second operating band, and a coupling portion connected between the first and the second radiation portion. The coupling element is disposed on the substrate. The coupling element and the coupling portion are separated from each other and coupling to each other. The feeding element is coupled between the coupling element and the grounding element and for feeding a signal. The conducting element is used to transmit a signal to the grounding element.

23 Claims, 21 Drawing Sheets

(51) Int. Cl.
*H01Q 5/328* (2015.01)
*H01Q 5/371* (2015.01)

(56) References Cited

U.S. PATENT DOCUMENTS 8,378,897 B2 * 2/2013 Lai ..... H01Q 9/42 343/700 MS
8,432,322 B2 4/2013 Amm et al.
8,466,839 B2 6/2013 Schlub et al.
8,577,289 B2 11/2013 Schlub et al.
9,276,320 B2 * 3/2016 Wu ..... H01Q 1/243
2004/0090374 A1 * 5/2004 Kuo Dai ..... H01Q 1/243 343/700 MS
2004/0104849 A1 * 6/2004 Tai ..... H01Q 1/243 343/700 MS
2005/0243006 A1 * 11/2005 Lin ..... H01Q 9/0421 343/770
2009/0128419 A1 * 5/2009 Tseng ..... H01Q 9/0442 343/700 MS
2010/0039328 A1 * 2/2010 Chiu ..... H01Q 9/42 343/700 MS
2010/0328182 A1 * 12/2010 Wong ..... H01Q 1/2266 343/848
2013/0120214 A1 * 5/2013 Tseng ..... H01Q 9/42 343/846
2013/0207861 A1 8/2013 Huang et al.
2013/0307732 A1 * 11/2013 Chiu ..... H01Q 5/364 343/700 MS
2013/0335258 A1 12/2013 Chung et al.
2014/0111382 A1 * 4/2014 Lee ..... H01Q 5/357 343/700 MS
2014/0315606 A1 * 10/2014 You ..... H04B 1/3838 455/575.5
2015/0311594 A1 * 10/2015 Zhu ..... H01Q 13/10 343/702

FOREIGN PATENT DOCUMENTS

CN 101958455 A 7/2014
TW 201134008 A1 10/2011

* cited by examiner

ANTENNA SYSTEM AND ANTENNA STRUCTURE THEREOF

BACKGROUND

1. Technical Field

The instant disclosure relates to a wireless communication technique, and in particular, to an antenna system and an antenna structure thereof.

2. Description of Related Art

With the prevalence of portable electronic devices (such as smart phones, tablets, notebooks), more and more attention is being drawn to wireless communication technology. The wireless communication quality of portable electronic devices depends on the antenna efficiency thereof. Therefore, how to increase the radiation efficiency of the antenna and how to more easily adjust the overall frequency has become an important issue in the art.

In addition, since the electromagnetic wave generated by the antenna is harmful to human body, the International Commission on Non-Ionizing Radiation Protection (ICNIRP) recommends that the value of the Specific Absorption Rate (SAR), which is the ratio of the mass of a living body to the absorbed electromagnetic energy, be less than 2.0 W/Kg, and Federal Communication Commission (FCC) recommends that the SAR be less than 1.6 W/Kg. However, in order to improve the antenna efficiency, the products in the existing art have relatively high SAR values.

Recently, products combining laptop and tablet are developed, such as Hybrid laptops or 2-in-1 laptops. The laptops can be operated under a general mode or under a tablet mode. However, the existing antenna structure cannot meet the recommended SAR value under the tablet mode. U.S. Pat. No. 8,577,289 discloses an "Antenna with integrated proximity sensor for proximity-based radio-frequency power control" which adjusts the emission power of the antenna according to human body signals. However, since in the abovementioned patent, two grounding capacitors are disposed between the feeding terminal and the transceiver for providing the antenna the function of detection, the two capacitors will adversely affect the antenna performance and reduce the detection distance thereof.

SUMMARY

The instant disclosure provides an antenna system and the antenna structure thereof for increasing the efficiency of the antenna while avoiding the problem that an SAR value is too high.

In order to solve the problem associated with the prior art, an embodiment of the present disclosure provides an antenna structure including a substrate, a radiation element, a coupling element, a grounding element, a feeding element and a conducting element. The radiation element is disposed on the substrate and includes a first radiation portion for providing a first operating band, a second radiation portion for providing a second operating band and a coupling portion connected between the first radiation portion and the second radiation portion. The coupling element is disposed on the substrate. The coupling element and the coupling portion are separated from each other and coupling to each other. The grounding element is separated from the coupling element. The feeding element is coupled between the coupling element and the grounding element for feeding a signal. The conducting element is coupled to the grounding element for transmitting the signal to the grounding element.

Another embodiment of the present disclosure provides an antenna structure including a substrate, a radiation element, a coupling element, a grounding element, a feeding element and a conducting element. The radiation element is disposed on the substrate and includes a first radiation portion for providing a first operating band, a second radiation portion for providing a second operating band and a coupling portion connected between the first radiation portion and the second radiation portion. The coupling element is disposed on the substrate. The coupling element is separated from the coupling portion and coupling to the coupling portion. The feeding element is coupled between the coupling portion of the radiation element and the grounding element, for feeding a signal. The conducting element is used to transmit the signal to the grounding element.

Another embodiment of the present disclosure provides an antenna system including an antenna structure, a proximity sensor circuit and an inductor. The antenna structure includes a substrate, a radiation element, a coupling element, a grounding element, a feeding element and a conducting element. The radiation element is disposed on the substrate and includes a first radiation portion for providing a first operating band, a second radiation portion for providing a second operating band and a coupling portion connected between the first radiation portion and the second radiation portion. The coupling element is disposed on the substrate. The coupling element and the coupling portion are separated from each other and coupling to each other. The grounding element is separated from the coupling element. The feeding element is coupled between the coupling element and the grounding element, for feeding a signal. The conducting element is used to transmit the signal to the grounding element. The inductor is coupled between the radiation element and the proximity sensor circuit. The radiation element is a sensing electrode and the proximity sensor circuit detects a capacitance value through the sensing electrode.

Another embodiment of the present disclosure provides an antenna system including an antenna structure, a proximity sensor circuit and an inductor. The antenna structure includes a substrate, a radiation element, a coupling element, a grounding element, a feeding element and a conducting element. The radiation element is disposed on the substrate and includes a first radiation portion for providing a first operating band, a second radiation portion for providing a second operating band and a coupling portion connected between the first radiation portion and the second radiation portion. The coupling element is disposed on the substrate. The coupling element and the coupling portion are separated from each other and coupling to each other. The feeding element is coupled between the coupling portion of the radiation element and the grounding element, for feeding a signal. The conducting element is used to transmit the signal to the grounding element. The inductor is connected between the radiation element and the proximity sensor circuit. The radiation element is a sensing electrode and the proximity sensor circuit detects a capacitance value through the sensing electrode.

The advantages of the instant disclosure is that the antenna system and the antenna structure thereof provided by the embodiments of the instant disclosure can not only increase the antenna performance but also prevent the SAR value from being too high while the user is close to the antenna system or structure.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1:
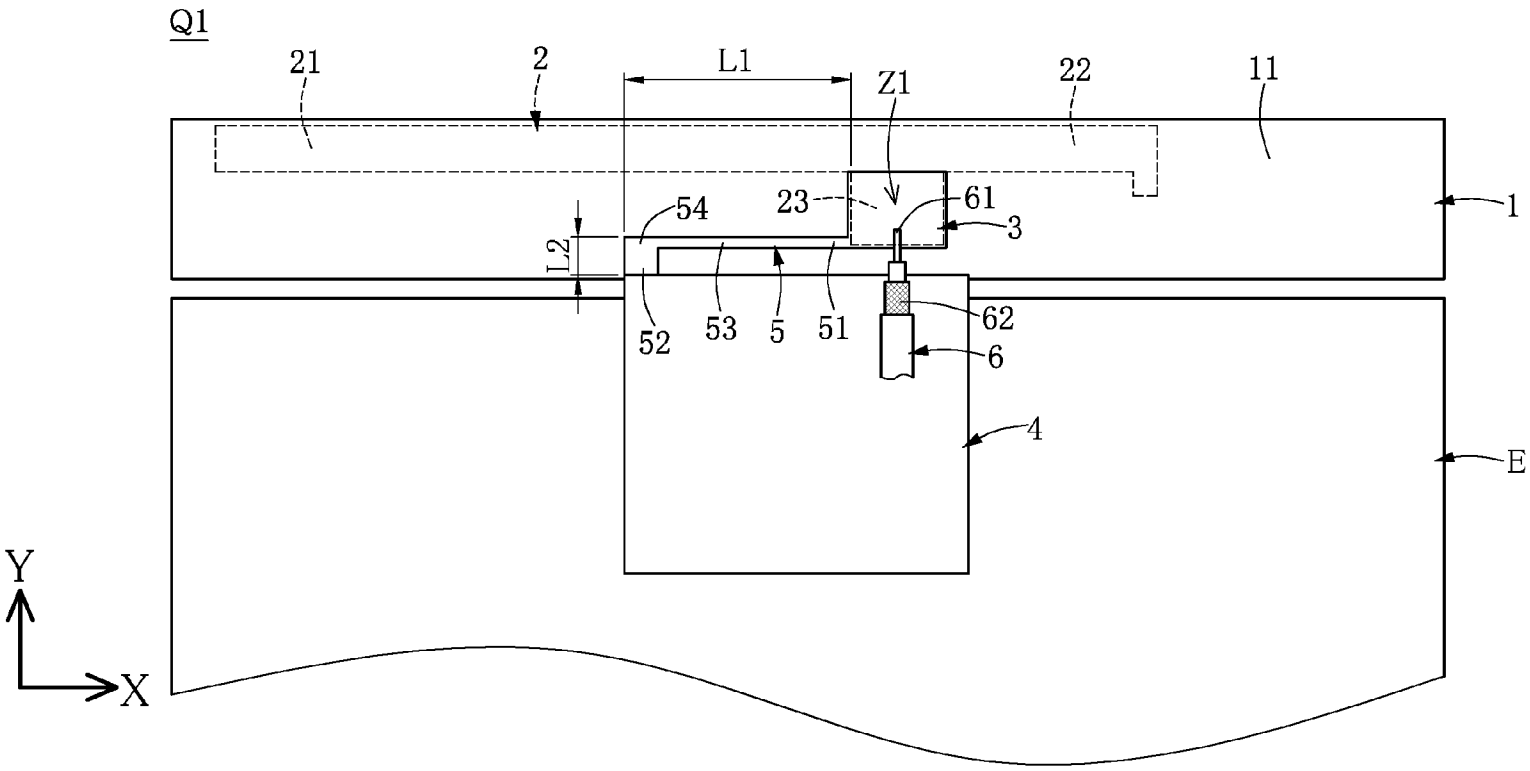
FIG. 1 is a top-perspective schematic view of the antenna structure of a first embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

It is worthwhile to mention that in the instant description, the terms "first", "second", "third", etc. are used to describe various elements or signals. However, these elements and signals are not limited by these terms. The terms are used to distinguish an element from another element, or to distinguish a signal from another signal. In addition, the term "or" is used to cover the combination of any one or more of the related subjects which are listed below.

In addition, it should be noted that in the instant description, the term "coupled with" or "coupled between" are used to refer to two or more elements which are directly or indirectly connected to each other, while the term "coupling to" indicates that the two or more elements have no physical contact therebetween.

First Embodiment

Figure 2:
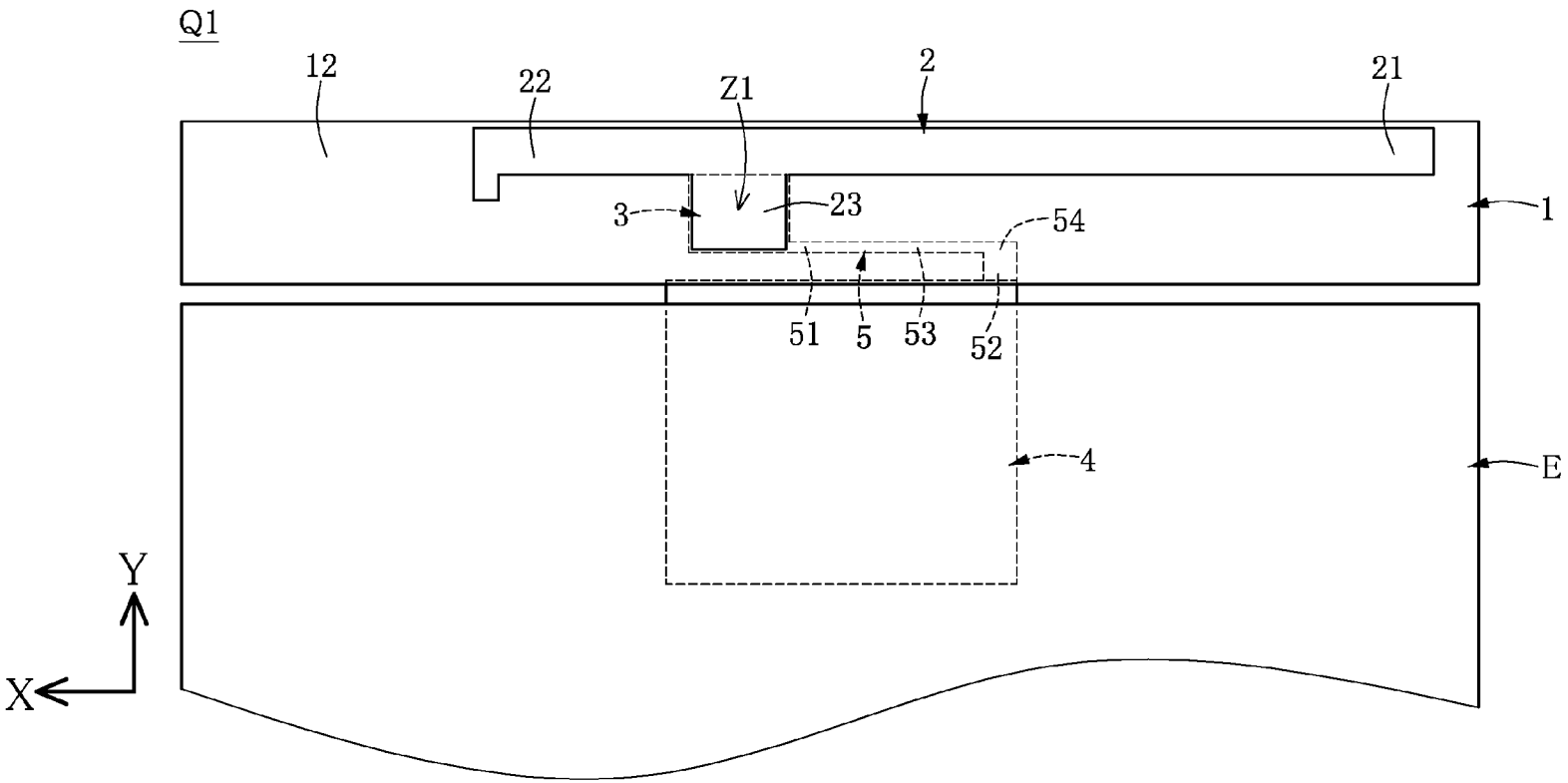
FIG. 2 is a bottom-perspective schematic view of the antenna structure of the first embodiment of the instant disclosure.

Referring to FIG. 1 and FIG. 2, FIG. 1 and FIG. 2 are the top-perspective schematic view and the bottom-perspective schematic view of the antenna structure of the first embodiment of the instant disclosure respectively. The first embodiment of the instant disclosure provides an antenna structure Q1 including a substrate 1, a radiation element 2, a coupling element 3, a grounding element 4, a conducting element 5 and a feeding element 6. The radiation element 2 and the coupling element 3 are disposed on the substrate 1, and the feeding element 6 is electrically connected to the coupling element 3 and the grounding element 4 for feeding a signal. The feeding element 6 can be a coaxial cable and have a feeding terminal 61 and a grounding terminal 62. The feeding terminal 61 can be electrically connected to the coupling element 3, and the grounding terminal 62 can be electrically connected to the grounding element 4. Therefore, the feeding element 6 can be used to feed a signal, and the conducting element 5 can be used to transmit the signal fed by the feeding element 6 to the grounding element 4.

In the first embodiment, the substrate 1 includes a first surface 11 (the upper surface) and a second surface 12 opposite to the first surface 11 (the lower surface). The coupling element 3 is disposed on the first surface 11 of the substrate 1, and the radiation element 2 is disposed on the second surface 12 of the substrate 1. Therefore, the coupling element 3 can be separated from a coupling portion 23 of the radiation element 2, and coupling to the coupling portion 23 of the radiation element 2. However, in other embodiments (such as the sixth embodiment), the radiation element 2 and the coupling element 3 can be disposed on the same surface. In the embodiments of the instant disclosure, the coupling element 3 is coupling to the coupling portion 23 of the radiation element 2, and the feeding element 6 is separated from the radiation element 2. In addition, the materials of the substrate 1, the radiation element 2, the coupling element 3, the grounding element 4, the conducting element 5 and the feeding element 6 can be easily selected by those skilled in the art. For example, the radiation element 2, the coupling element 3, the grounding element 4 and the conductive element can be metal sheets, metal conductive lines or other conductors. It should be noted that in the instant disclosure, the coupling between the coupling element 3 and the coupling portion 23 of the radiation element 2 is achieved under the condition that the coupling element 3 and the coupling portion 23 of the radiation element 2 are separated from each other, and is different from a connection way which is under the condition that a coupling element and a radiation element are connected with each other directly or indirectly.

Referring to FIG. 1, the conducting element 5 is disposed on the first surface 11, and the conducting element 5 is coupled between the coupling element 3 and the grounding element 4. The conducting element 5 can be integrally formed with the coupling element 3 and hence, the conducting element 5 extends from the coupling element 3 to the grounding element 4. The grounding element 4 is electrically connected to a metal conductor E which can be separated from the substrate 1. In addition, the conducting element 5 can have a first portion 51 coupled with to the coupling element 3 and a second portion 52 coupled with the grounding element 4. In the first embodiment, the conducting element 5 has an extension portion 53 extending from the coupling element 3 and a bending portion 54 bending from the extension portion 53 and extending to the grounding element 4. In addition, the first portion 51 is located on the extension portion 53, and the second portion 52 is located on the bending portion 54. Therefore, the conducting element 5 is coupled with the coupling element 3 through the extension portion 53 (the first portion 51), and is electrically connected to the grounding element 4 through the bending portion 54 (the second portion 52). In other words, when the antenna structure Q1 is disposed on the X-Y plane (as shown in FIG. 1), the extension portion 53 extends along a first direction (the negative-X direction), the bending portion 54 extends along a third direction (the negative-Y direction), and the extension portion 53 and the bending portion 54 are substantially perpendicular to each other.

Referring to FIG. 2, the radiation element 2 is disposed on the substrate 1, and the radiation element 2 includes a first radiation portion 21 for providing a first operating band, a second radiation portion 22 for providing a second operating band and a coupling portion 23 coupled between the first radiation portion 21 and the second radiation portion 22. Specifically, the first radiation portion 21 extends from the coupling portion 23 (which connects the first radiation portion 21 to the second radiation portion 22) toward the first direction (the negative-X direction), and the second radiation portion 22 extends from the coupling portion 23 toward a second direction (the positive-X direction), in which the first direction and the second direction are different. In other words, the first radiation portion 21 and the second radiation portion 22 extend outwardly from two opposite ends of the coupling portion 23 respectively. The extending direction of the coupling portion 23 is substantially perpendicular to the extending directions of the first radiation portion 21 and the second radiation portion 22.

In the embodiments of the instant disclosure, the length of the first radiation portion 21 is larger than that of the second radiation portion 22. The bandwidth of the first operating band provided by the first radiation portion 21 is from 698 MHz and 960 MHz, and the bandwidth of the second operating band provided by the second radiation portion 22 is from 1425 MHz to 2690 MHz. Therefore, the first and second operating bands can be used in different Long Term Evolution (LTE) bands. However, the instant disclosure is not limited thereto. In the following embodiments, the bandwidth of the first operating band is from 698 MHz to 960 MHz, and the bandwidth of the second operating band is from 1425 MHz to 2690 MHz.

Next, referring to FIG. 1 and FIG. 2, the overlapping area between the coupling element 3 and the coupling portion 23 is defined as a first coupling area Z1 (the overlapping region of the orthographic projections of the coupling element 3 and the coupling portion 23 on the X-Y plane), and the area of the first coupling area Z1 (the coupling degree between the coupling element 3 and the coupling portion 23) is proportional to the bandwidth of the operating band generated by the antenna structure Q1. In addition, the area of the first coupling area Z1 is inversely proportional to the center frequency of the operating band generated by the antenna structure Q1. In other words, when the first coupling area Z1 decreases, the bandwidth of the operating band generated by the antenna structure Q1 decreases and the center frequency of the operating band generated by the antenna structure Q1 increases. In addition, the area of the first coupling area Z1 is proportional to the degree to which the impedance value approaches a predetermined impedance value, i.e., the larger the area of the first coupling area Z1 is (the coupling degree between the coupling element 3 and the coupling portion 23 or the coupling amount between the coupling element 3 and the coupling portion 23), the closer the impedance value corresponding to the central frequency of the antenna structure Q1 is to the predetermined impedance. Similarly, the smaller the area of the first coupling area Z1 is, the larger of the distance between the impedance value corresponding to the central frequency of the antenna structure Q1 and the predetermined impedance value is.

When the first coupling area Z1 changes, the variation degree of the bandwidth and the center frequency of the first operating band is larger than that of the second operating band, in which the second operating band is higher than the first operating band. In addition, although the figures show that the area of the coupling portion 23 is smaller than that of the coupling element 3, the area of the coupling portion 23 can be larger than or equal to that of the coupling element 3 in other embodiments. The area of the first coupling area Z1 can be further adjusted by adjusting the relative position between the coupling portion 23 and the coupling element 3 or by adjusting the area of the coupling portion 23 and the coupling element 3.

The total length of the conducting element 5 extending from the coupling element 3 to the grounding element 4 is defined as an extension length (the sum of the first length L1 and the second length L2). The extension length of the conducting element 5 is proportional to the bandwidth of the operating band generated by the antenna structure Q1, and the extension length of the conducting element 5 is inversely proportional to the impedance value corresponding to the center frequency of the operating band generated by the antenna structure Q1. In other words, when the extension length of the conducting element 5 decreases, the bandwidth of the operating band generated by the antenna structure Q1 decreases, and the impedance value corresponding to the center frequency of the operating band generated by the antenna structure Q1 increases. Similarly, when the extension length of the conducting element 5 increases, the impedance value corresponding to the center frequency of the operating band generated by the antenna structure Q1 decreases. It should be noted that the closer the impedance value is to the predetermined value, the closer the voltage standing wave ration (VSWR) is to 1, in which the VSWR corresponds to the center frequency of the operating band.

For example, the closer the impedance value is to 50, the closer the voltage standing wave ration (VSWR) is to 1, in which the VSWR corresponds to the center frequency of the operating band.

In addition, in the first embodiment, the conducting element 5 has an extension portion 53 and a bending portion 54 coupled to the extension portion 53. The extension length of the conducting element 5 can be the sum of the first length L1 of the extension portion 53 and the second length L2 of the bending portion 54. The first length L1 starts from the edge of the first coupling area Z1 of the coupling area Z formed by the coupling element 3 and the coupling portion 23 and ends at the edge of the bending portion 54, and the second length L2 starts from the edge of the extension portion 53 and ends at the intersection of the bending portion 54 and the grounding element 4.

Figure 3:
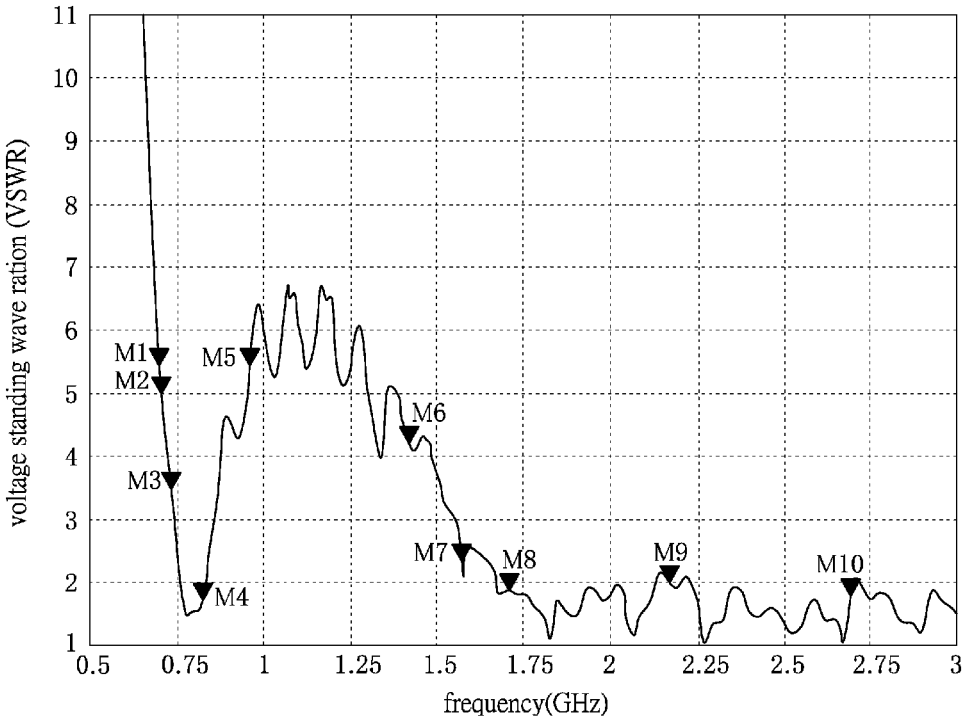
FIG. 3 is a voltage standing wave ratio diagram of the first embodiment of the instant disclosure.

Reference is next made to FIG. 3 and the following Table 1. FIG. 3 is a voltage standing wave ratio diagram of the first embodiment.

TABLE 1

| nodes | frequency(MHz) | VSWR |
|---|---|---|
| M1 | 698 | 5.45 |
| M2 | 704 | 5.02 |
| M3 | 734 | 3.48 |
| M4 | 824 | 1.76 |
| M5 | 960 | 5.45 |
| M6 | 1425 | 4.21 |
| M7 | 1575 | 2.34 |
| M8 | 1710 | 1.86 |
| M9 | 2170 | 2.01 |
| M10 | 2690 | 1.78 |

Second Embodiment

Figure 4:
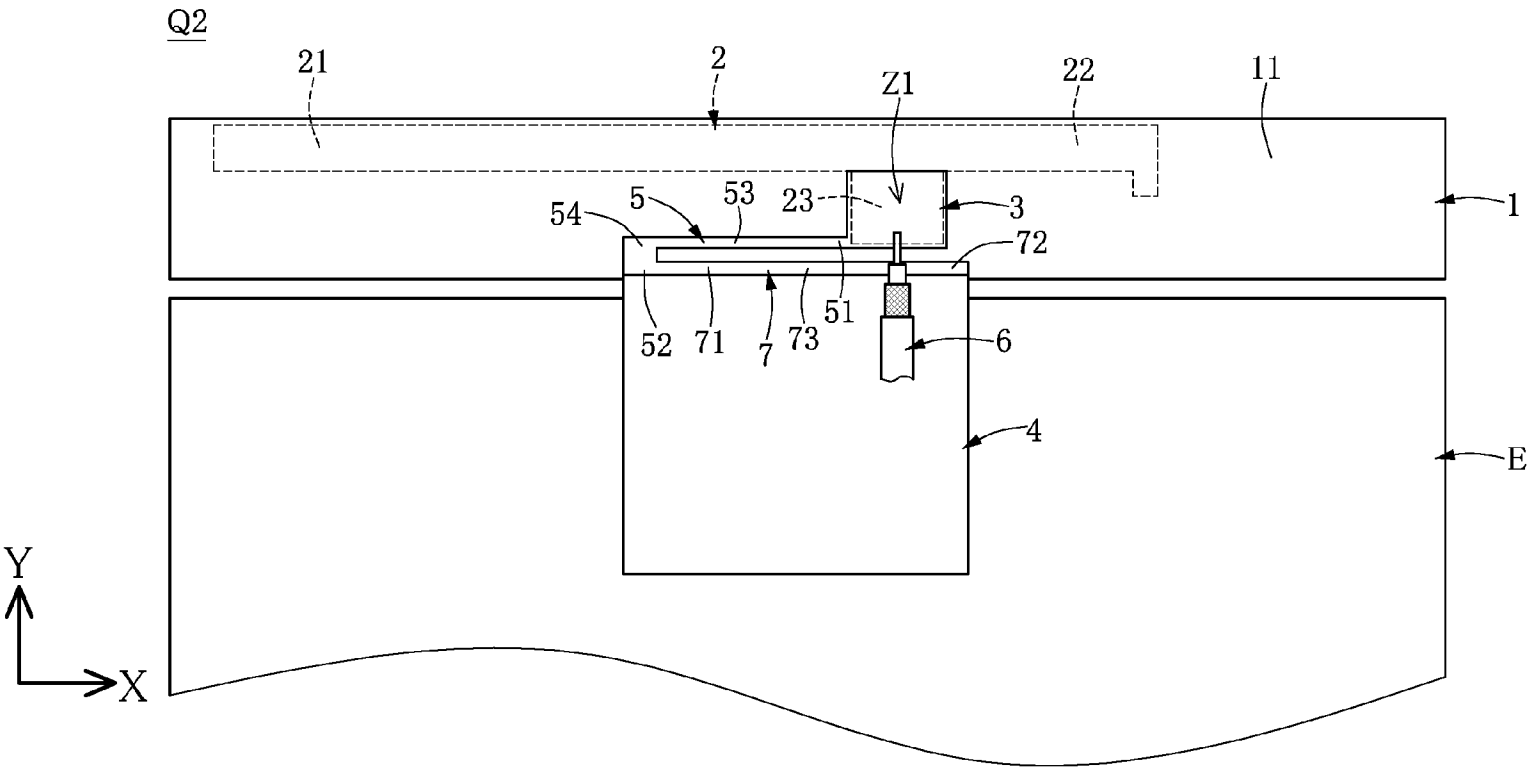
FIG. 4 is a top-perspective schematic view of the antenna structure of a second embodiment of the instant disclosure.

Reference is made to FIG. 4, which is a top-perspective schematic view of the antenna structure of the second embodiment. Compared with FIG. 1, the main difference between the first embodiment and the second embodiment is that the antenna structure Q2 of the second embodiment further includes a bridging element 7. Specifically, the bridging element 7 is disposed on the first surface 11 of the substrate 1 and is coupled between the conducting element 5 and the grounding element 4. The bridging element 7 has a first end 71, a second end 72 opposite to the first end 71 and a main body 73 coupled between the first end 71 and the second end 72. In the second embodiment, the first end 71 is coupled with the bending portion 54, and the main body 73 is electrically connected to the grounding element 4. In other words, the first end 71 of the bridging element 7 is coupled with the second portion 52.

It should be noted that in the second embodiment, the coupling element 3, the conducting element 5 and the bridging element 7 can be formed as one piece. In addition, the substrate 1, the radiation element 2, the coupling element 3, the grounding element 4, the conducting element 5 and the feeding element 6 are similar to those of the previous embodiment and are not reiterated herein. The bridging element 7 is formed for enabling the grounding element 4 to be easily attached on the substrate. However, the bridging element 7 presented in the second embodiment is an optional element and can be omitted in other embodiments. In other words, the antenna structure Q2 with the bridging element 7 includes the grounding terminal 62 of the feeding element 6 electrically connected to the bridging element 7 or the grounding element 4. Therefore, the grounding terminal 62 can be indirectly connected to the grounding element 4. However, the instant disclosure is not limited thereto. In addition, the material of the bridging element 7 can be tin and the material of the grounding element can be copper. However, the instant disclosure is not limited thereto.

Third Embodiment

Figure 5:
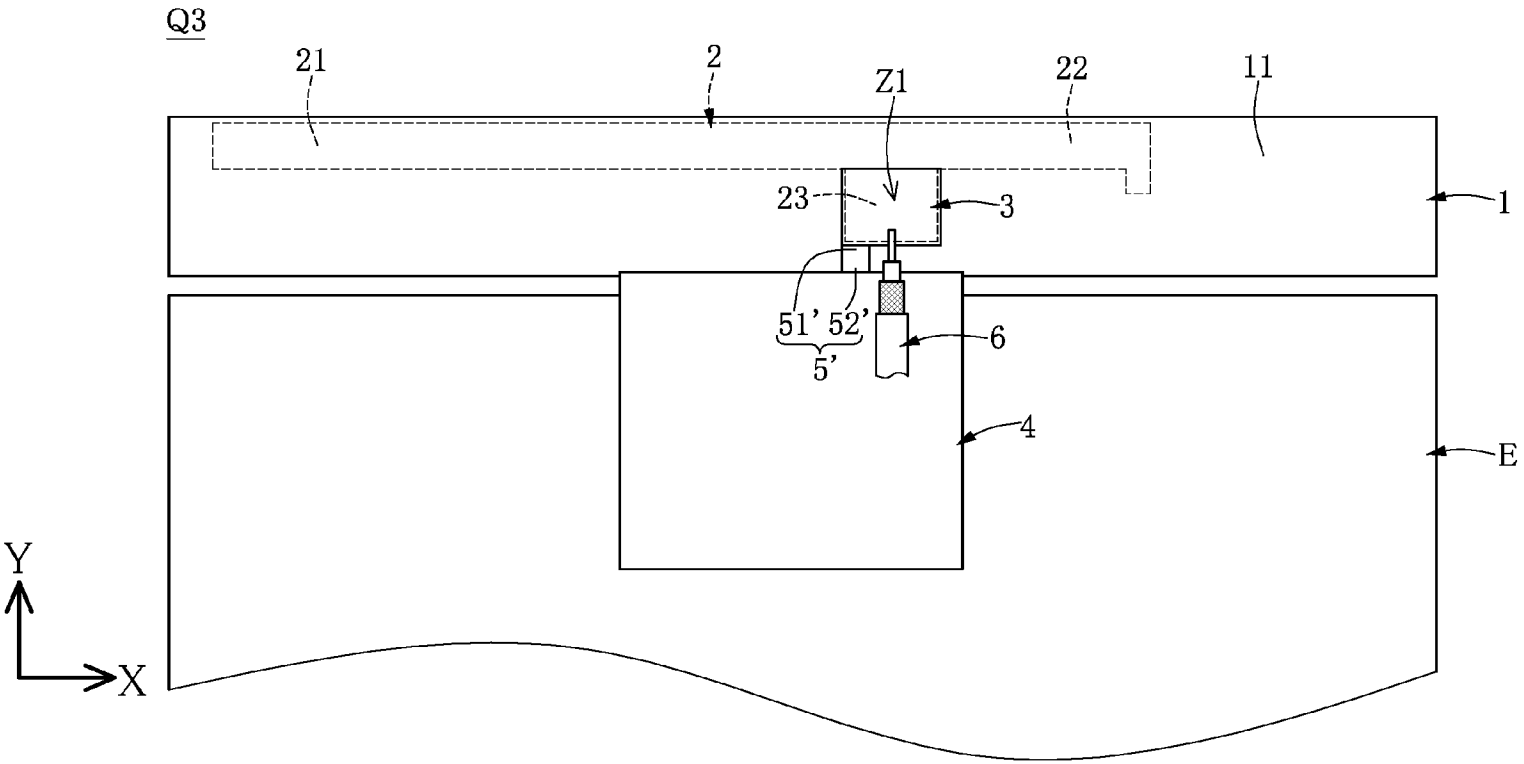
FIG. 5 is a top-perspective schematic view of the antenna structure of a third embodiment of the instant disclosure.

Reference is made to FIG. 5, which is a top-perspective schematic view of the antenna structure of the third embodiment. Compared with FIG. 1, the main difference between the third embodiment and the first embodiment is that the conducting element 5' of the antenna structure Q3 of the third embodiment is different from the conducting element 5 provided by the first embodiment. For example, the conducting element 5' can be an inductor disposed between (bridging) the coupling element 3 and the grounding element 4. The inductor can have a first end 51' and a second end 52' opposite to the first end 51'. The inductor is electrically connected to the coupling element 3 through the first end 51' and is electrically connected to the grounding element 4 through the second end 52'.

In addition, by changing between different inductors (the conducting element 5'), the inductance value can be adjusted, thereby indirectly changing the bandwidth of the operating band and the center frequency of the operating band. In the third embodiment, the inductance value provided by the inductor is proportional to the bandwidth of the operating band generated by the antenna structure Q3, and the decreasing (reducing) level of the inductance value provided by the inductor is inversely proportional to an impedance value corresponding to a center frequency of an operating frequency generated by the antenna structure. In other words, if the inductance value provided by the inductor decreases, the bandwidth of the operating band generated by the antenna structure Q3 decreases and the impedance value corresponding to the center frequency of an operating frequency generated by the antenna structure Q3 increases. In contrast thereto, if the inductance value provided by the inductor increases, the bandwidth of the operating band generated by the antenna structure Q3 increases and the impedance value corresponding to the center frequency of an operating frequency generated by the antenna structure Q3 decreases. For example, when the inductance value of the inductor is 6.8 nH (a reference value), if the inductance value increases, the bandwidth of the operating band generated by the antenna structure Q3 increases; when the inductance value decreases, the bandwidth of the operating band generated by the antenna structure Q3 decreases. In other words, if the inductance value decreases, the impedance value of the center frequency increases and the bandwidth at low frequency becomes narrower; and if the inductance value increases, the impedance value of the center frequency decreases and the bandwidth at low frequency becomes wider.

It should be noted that compared with the antenna structure Q1 of the first embodiment, which has the extension portion 53 and the bending portion 54 to serve as the conducting element 5, the inductor serving as the conducting element 5' in the third embodiment can significantly reduce the volume of the antenna structure Q3. In addition, the structures of the substrate 1, the radiation element 2, the coupling element 3, the grounding element 4 and the feeding element 6 of the third embodiment are similar to that of the previous embodiments and are not reiterated herein. Furthermore, when an inductor is used as the conducting element 5', the impedance matching of the low frequency and the high frequency can be adjusted. Preferably, the use of the inductor can primarily adjust the bandwidth in low frequency of the operating band.

Fourth Embodiment

Figure 6:
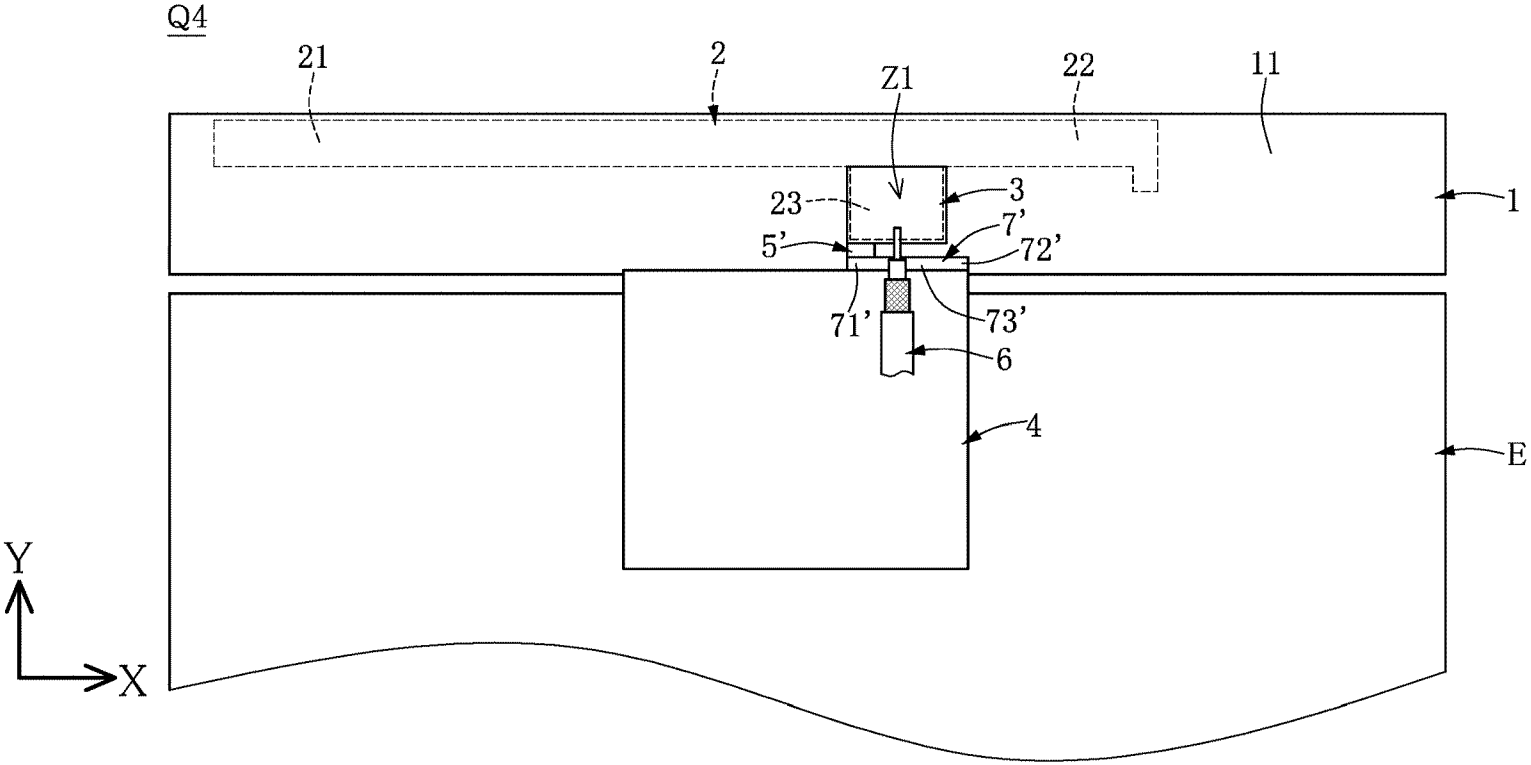
FIG. 6 is a top-perspective schematic view of the antenna structure of a fourth embodiment of the instant disclosure.

Reference is made to FIG. 6, which is the top-perspective schematic view of the antenna structure of the fourth embodiment. Compared with FIG. 5, the main difference between the fourth embodiment and the third embodiment is that the antenna structure Q4 of the fourth embodiment further includes a bridging element 7'. The bridging element 7' has a first end 71', a second end 72' and a main body 73'. The bridging element 7' is disposed between the conducting element 5' and the grounding element 4. The first end 71' of the bridging element 7' can be electrically connected to the second portion 52' of the conducting element 5', and the main body 73' can be electrically connected to the grounding element 4. The structures of other elements of the fourth embodiment are similar to those of the previous embodiments and are not reiterated herein.

Fifth Embodiment

Figure 7:
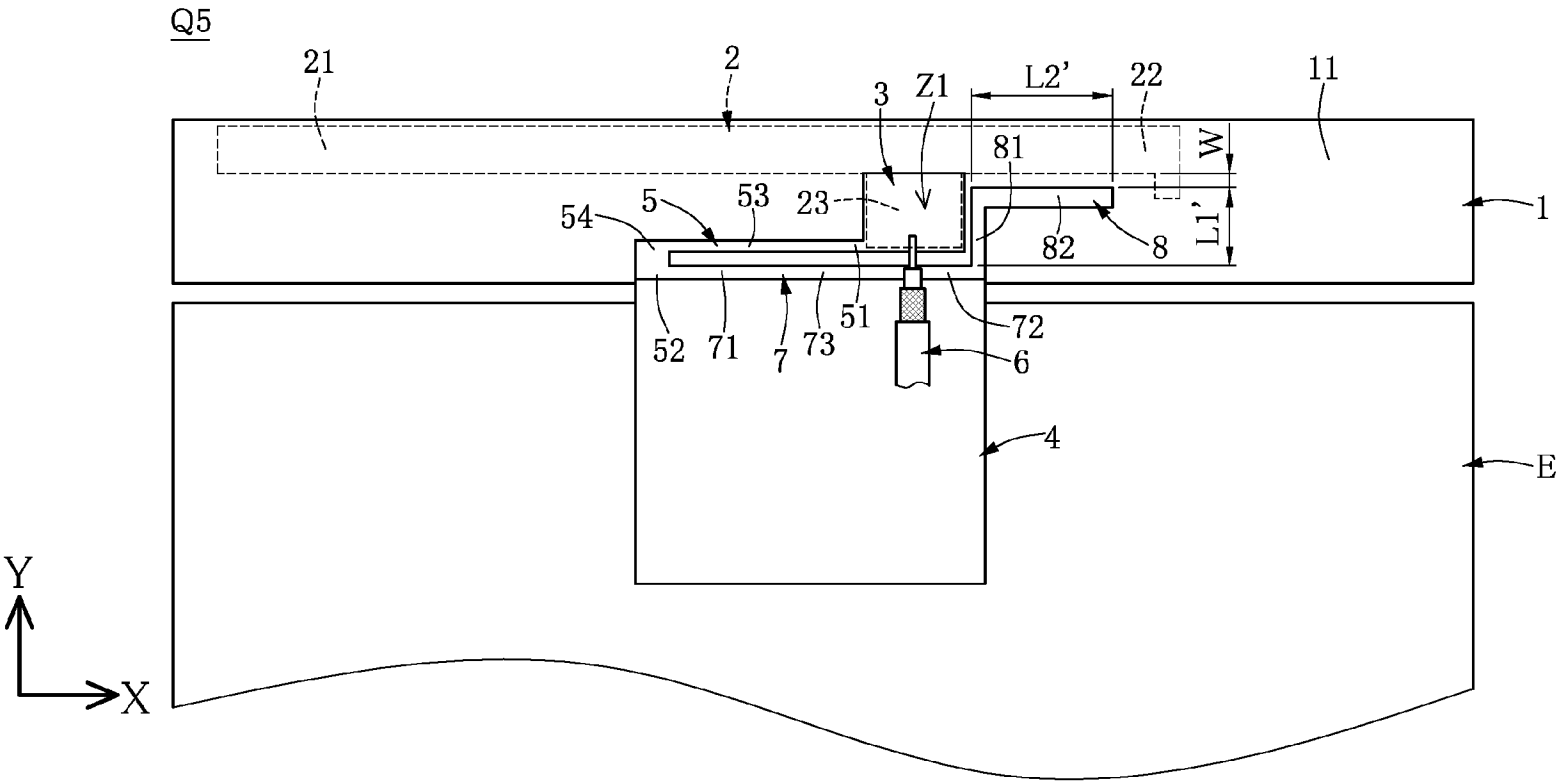
FIG. 7 is a top-perspective schematic view of the antenna structure of a fifth embodiment of the instant disclosure.

Reference is made to FIG. 7, which is the top-perspective schematic view of the antenna structure of the fifth embodiment. Compared with FIG. 4, the main difference between the fifth embodiment and the second embodiment is that the antenna structure Q5 in the fifth embodiment further includes a parasitic element 8 disposed adjacent to the second radiation portion 22. The parasitic element 8 can be coupled with the grounding element 4, and is not overlapped with the second radiation portion 22. Therefore, the parasitic element 8 can be used to adjust the impedance value corresponding to the center frequency of the second operating band and the bandwidth of the second operating band.

Specifically, the parasitic element 8 can have a first parasitic portion 81 coupled with the second end 72 of the bridging element 7 and a second parasitic portion 82 coupled with the first parasitic portion 81. For example, the first parasitic portion 81 extends along a fourth direction (the positive-Y direction) approaching to the second radiation portion 22, and the second parasitic portion 82 extends along a second direction (the positive-X direction) away from the coupling element 3. The extending direction of the second parasitic portion 82 is substantially parallel to the extending direction of the second radiation portion 22. In addition, as shown in FIG. 7, a predetermined slit W is presented between the second parasitic portion 82 of the parasitic element 8 and the second radiation portion 22, and when the horizontal shift distance of the second parasitic portion 82 of the parasitic element 8 relative to the second radiation portion 22 (otherwise referred to as a predetermined slit W, i.e., the distance between the second parasitic portion 82 of the parasitic element 8 and the second radiation portion 22) decreases, the impedance value corresponding to the center frequency of the second operating band is closer to a predetermined impedance value. When the impedance value becomes closer to the predetermined impedance value, the voltage standing wave ratio is closer to 1.

In addition, the extension length of the parasitic element 8 is inversely proportional to the bandwidth of the second operating band generated by the antenna structure Q5. In other words, the smaller the extension length is, the higher the bandwidth of the operating band generated by the antenna structure Q5 will be. For example, the extension length of the parasitic element 8 can be the total length of a first length L1' of the first parasitic portion 81 and a second length L2' of the second parasitic portion 82. The first length L1' is defined between the connection point of the parasitic element 8 and the bridging element 7, and the edge of the second parasitic portion 82, and the second length L2' is defined between the edge of the first parasitic portion 81 and the end of the second parasitic portion 82.

Although the fifth embodiment illustrates that the parasitic element 8 is coupled with the bridging element 7, the bridging element 7 can be omitted in other embodiments. In other embodiments, the grounding element 4 can directly be electrically connected to the parasitic element 8 for enabling the parasitic element 8 to be disposed adjacent to the second radiation portion 22 and not overlap with the second radiation portion 22. In other words, the projection of the parasitic element 8 on the X-Y plane does not overlap with the projection of the second radiation portion 22 on the X-Y plane. The parasitic element 8 can have a first parasitic portion 81 coupled with the grounding element 4 and a second parasitic portion 82 bending and extending from the first parasitic portion 81 towards the coupling element 3. Therefore, the impedance value of the second operating band and the bandwidth of the operating band can be adjusted.

In addition, by disposing the parasitic element 8 adjacent to the second radiation portion 22 of the antenna structure Q5, the performance of the second operating band can be enhanced. Preferably, the performance of the second operating band can be enhanced between 2000 MHZ to 3000 MHZ; more preferably, in 2600 MHZ. In other words, the voltage standing wave ratio with the bandwidth 2000 MHZ to 3000 MHZ can be close to 1 based on the parasitic element 8. The structures of the other elements in the fifth embodiment are similar to that of the previous embodiments and are not reiterated herein.

Sixth Embodiment

Figure 8:
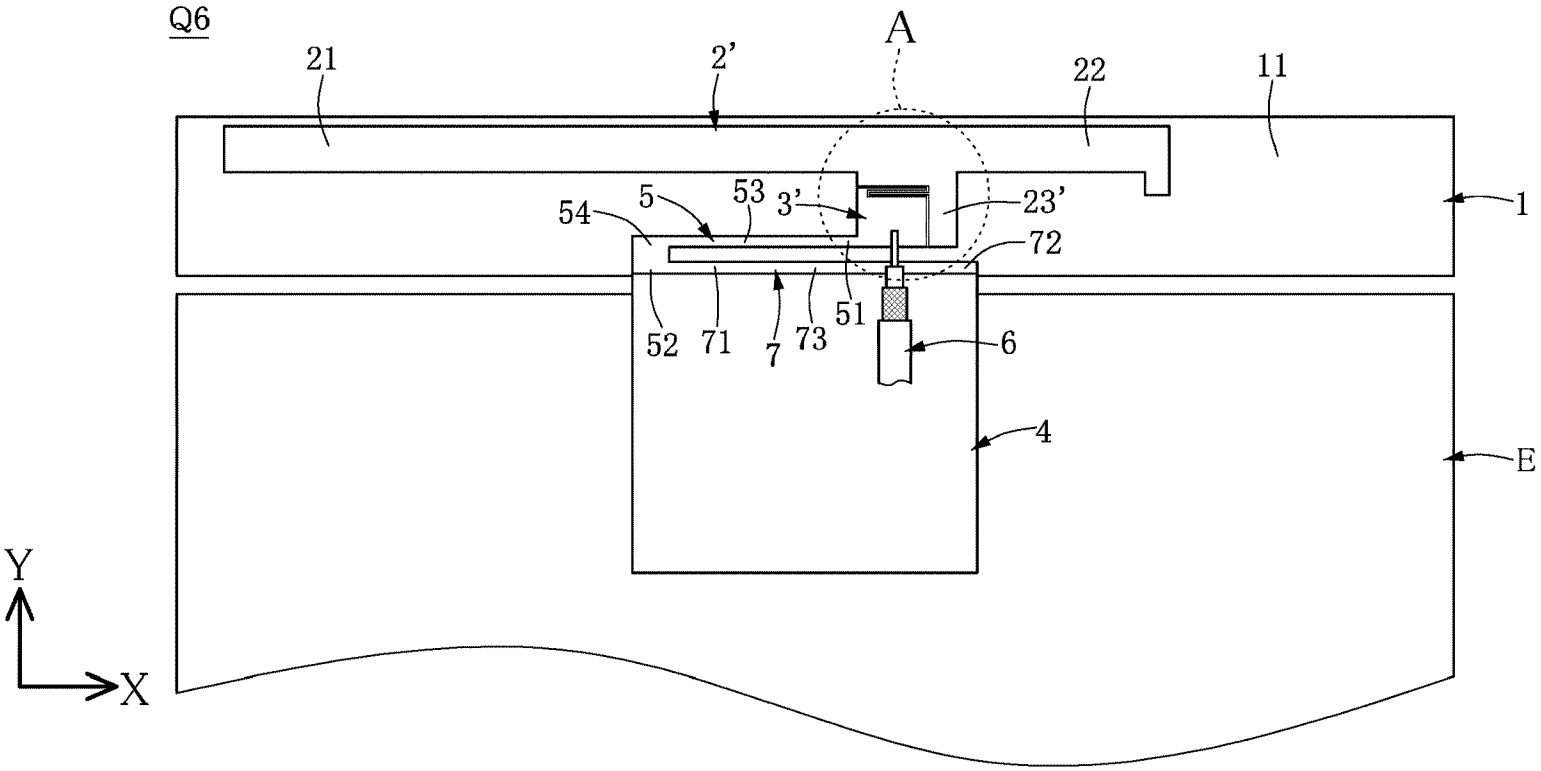
FIG. 8 is a top-perspective schematic view of the antenna structure of a sixth embodiment of the instant disclosure.

Reference is made to FIG. 8, which is the top-perspective schematic view of the antenna structure of the sixth embodiment. Compared with FIG. 1, the main difference between the sixth embodiment and the second embodiment is that the coupling element 3' and the radiation element 2' of the sixth embodiment are both disposed on the first surface 11 of the substrate 1 and are adjacent to each other. Specifically, the antenna structure Q6 provided by the sixth embodiment utilizes the coupling property between the coupling element 3' and the coupling portion 23' of the radiation element 2' to enable the antenna structure Q6 to produce a corresponding signal transceiving effect.

Figure 9:
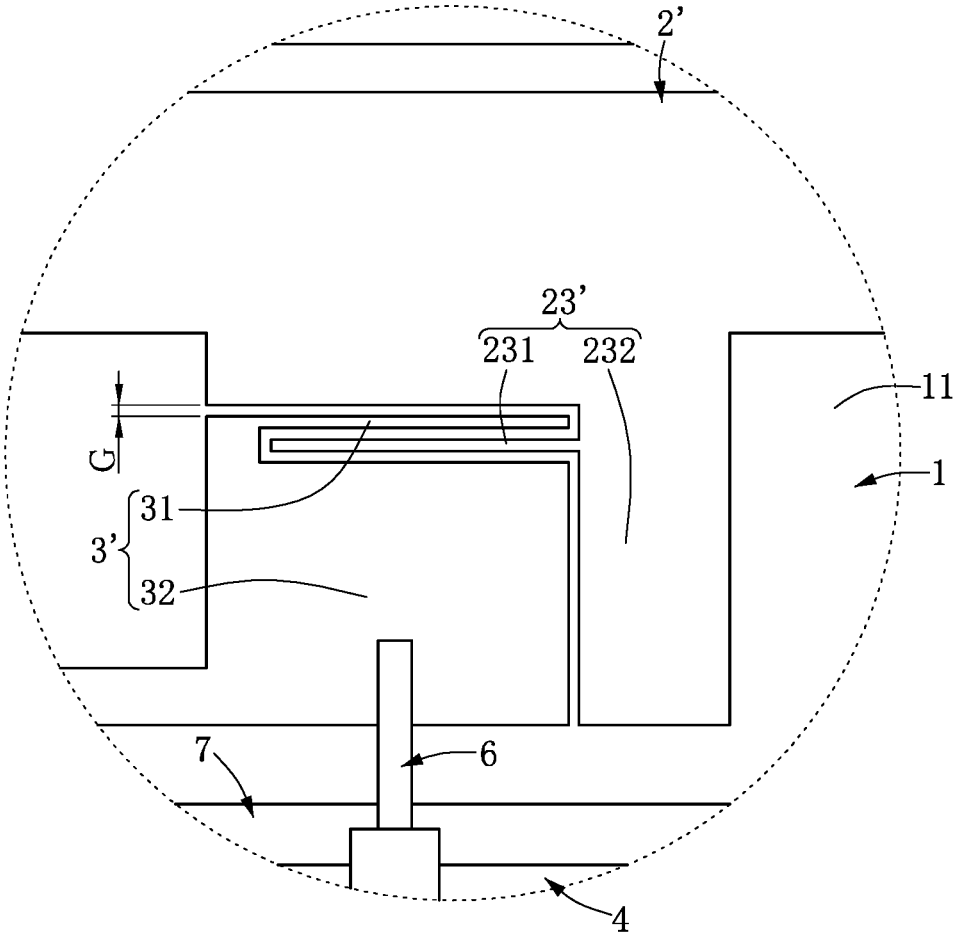
FIG. 9 is an enlarged view of part IX in FIG. 8.

Reference is made to FIG. 9, which is an enlarged view of part IX of FIG. 8. For example, the coupling portion 23' has a coupling section (the first coupling section 231 and/or the second coupling section 232), and the coupling element 3' has a coupling arm (the first coupling arm 31 and/or the second coupling arm 32). One or more coupling gap G is located between the coupling section and the coupling arm. The coupling degree between the coupling section and the coupling arm (the coupling amount, i.e., the coupling length of the coupling section and the coupling arm) is proportional to the bandwidth of the operating band generated by the antenna structure Q6. Moreover, the coupling degree (coupling amount) between the coupling section and the coupling arm is inversely proportional to the center frequency of the operating band generated by the antenna structure Q6. In addition, the smaller the coupling gap G is, the larger the coupling amount will be. Therefore, the distance of the coupling gap G is inversely proportional to the bandwidth of the operating band generated by the antenna structure Q6, and is proportional to the center frequency of the operating band generated by the antenna structure Q6. In other words, when the coupling degree decreases or the distance of the coupling gap G increases, the bandwidth of the operating band generated by the antenna structure Q6 will decrease, and the center frequency of the operating band generated by the antenna structure Q6 will increase.

In the embodiment shown in FIG. 9, the coupling portion 23' has a first coupling section 231 and a second coupling section 232 coupled with the first coupling section 231. The first coupling section 231 extends along a first direction (the direction opposite to the X direction), and the second coupling section 232 extends along a third direction (the direction opposite to the Y direction). In addition, the coupling arm can have a first coupling arm 31 and a second coupling arm 32 coupled with the first coupling arm 31. The first coupling arm 31 extends along a second direction (the X direction), and the second coupling arm 32 extends along a third direction (the direction opposite to the Y direction). Therefore, the coupling section and the coupling arm couple with each other.

In other embodiments, a plurality of first coupling sections 231*s* and a plurality of first coupling arm 31*s* can be provided to increase the first coupling area Z1 between the coupling portion 23' and the coupling element 3'. Therefore, a plurality of coupling gaps G are located between the plurality of first coupling section 231*s* and a plurality of first coupling arm 31*s*. The plurality of first coupling section 231*s* and the plurality of first coupling arm 31*s* are arranged alternatively. The structures of the other elements in the sixth embodiment are similar to those of the previous embodiments and are not reiterated herein.

Seventh Embodiment

Figure 10:
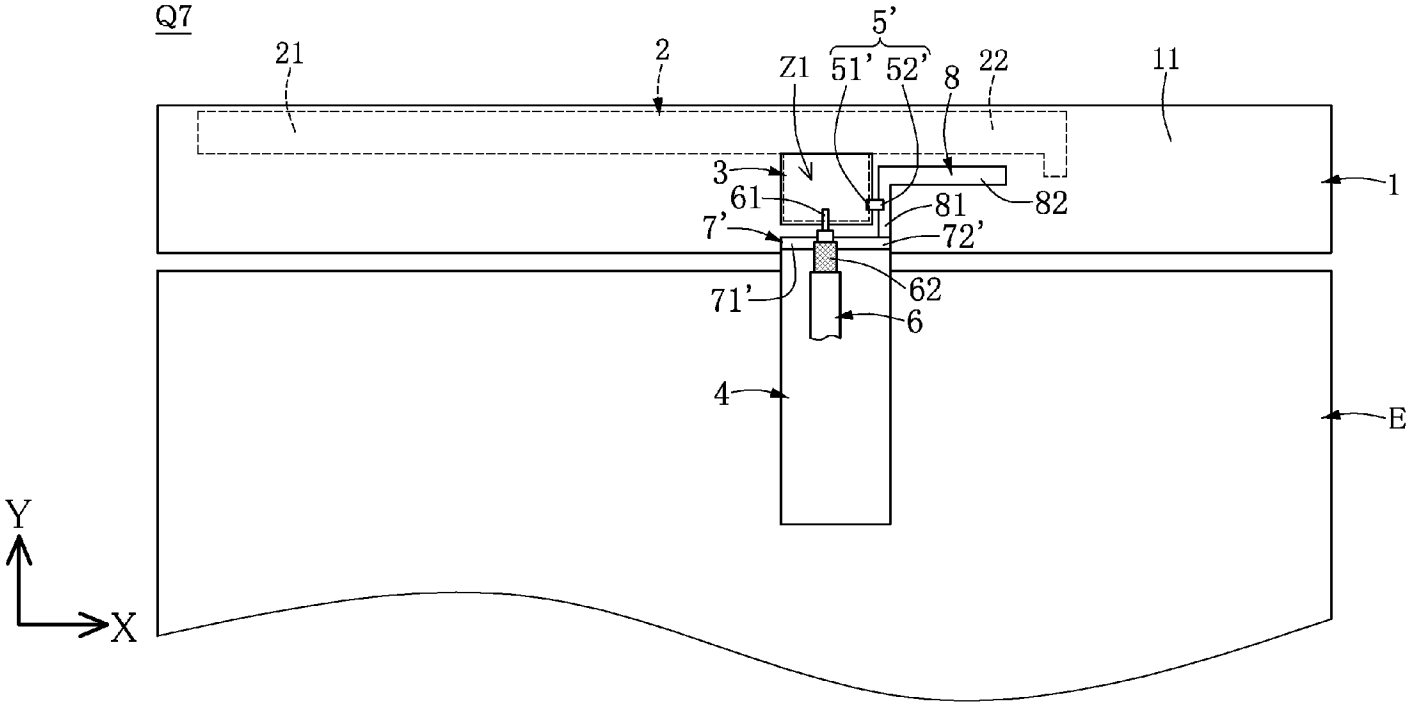
FIG. 10 is a top-perspective schematic view of the antenna structure of a seventh embodiment of the instant disclosure.

Reference is made to FIG. 10. Compared with FIG. 7, the main difference between the seventh embodiment and the first embodiment is that an end (the second end 52') of the conducting element 5' of the antenna structure Q7 is coupled with the parasitic element 8, and the other end (the first end 51') of the conducting element 5' is coupled with the coupling element 3, i.e., the first end 51' is coupled between the coupling element 3 and the parasitic element 8. The conducting element 5' can be indirectly connected to the grounding element 4. The parasitic element 8 can be coupled with the grounding element 4 through the parasitic element 8 and a bridging element 7', i.e., the bridging element 7' is coupled between the conducting element 5' and the grounding element 4. It should be noted that in other embodiments, the bridging element 7' can be omitted and the parasitic element 8 is directly connected to the grounding element 4. In addition, in the antenna structure Q7 with the bridging element 7', the feeding terminal 61 of the feeding element 6 can be electrically connected to the coupling element 3, and the grounding element 62 of the feeding element can be electrically connected to the bridging element 7', and hence, the grounding terminal 62 is electrically connected to the grounding element 4. The structures of the other elements in the seventh embodiment are similar to that of the previous embodiments and are not reiterated herein.

Reference is made to FIG. 10. The parasitic element 8 has a first parasitic portion 81 coupled with the grounding element 4 and a second parasitic portion 82 bending from the first parasitic portion 81 and extending away from the coupling element 3. Therefore, the conducting element 5' can be coupled between the coupling element 3 and the first parasitic portion 81, and the conducting element 5' is indirectly connected to the grounding element 4. For example, the conducting element 5' can be an inductor, a metal sheet, a metal conductive line or other electrical conductor disposed between the coupling element 3 and the first parasitic portion 81. Therefore, when the conducting element 5' is an inductor element, the inductor element (the conducting element 5') can provide an inductance value which adjusts the bandwidth of the operation band generated by the antenna structure, and the impedance value corresponding to the central frequency of the operation band. In other words, as mentioned in the previous embodiments, when the inductance value provided by the inductor decreases, the bandwidth of the operation band decrease and the impedance corresponding to the central frequency of the operation band increases. When the inductance value provided by the inductance element increases, the bandwidth of the operation band generated by the antenna structure Q7 increases, and the impedance value corresponding to the central frequency of the operation band generated by the antenna structure Q7 decreases. It should be noted that, as shown in the embodiment of FIG. 7, when the horizontal shift distance of the second parasitic portion 82 of the parasitic element 8 relative to the second radiation portion 22 decreases, the impedance value corresponding to the center frequency of the second operating band approaches a predetermined impedance value.

Eighth Embodiment

Figure 11:
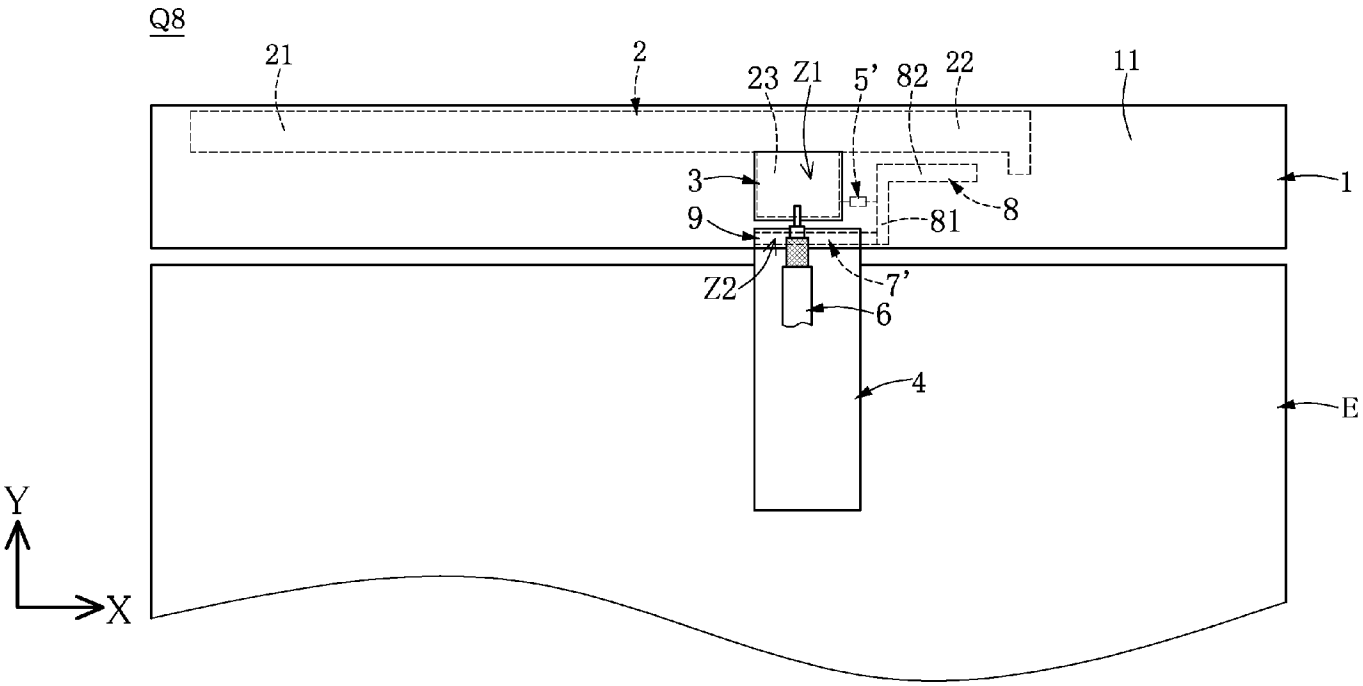
FIG. 11 is a top-perspective schematic view of the antenna structure of an eighth embodiment of the instant disclosure.
Figure 12:
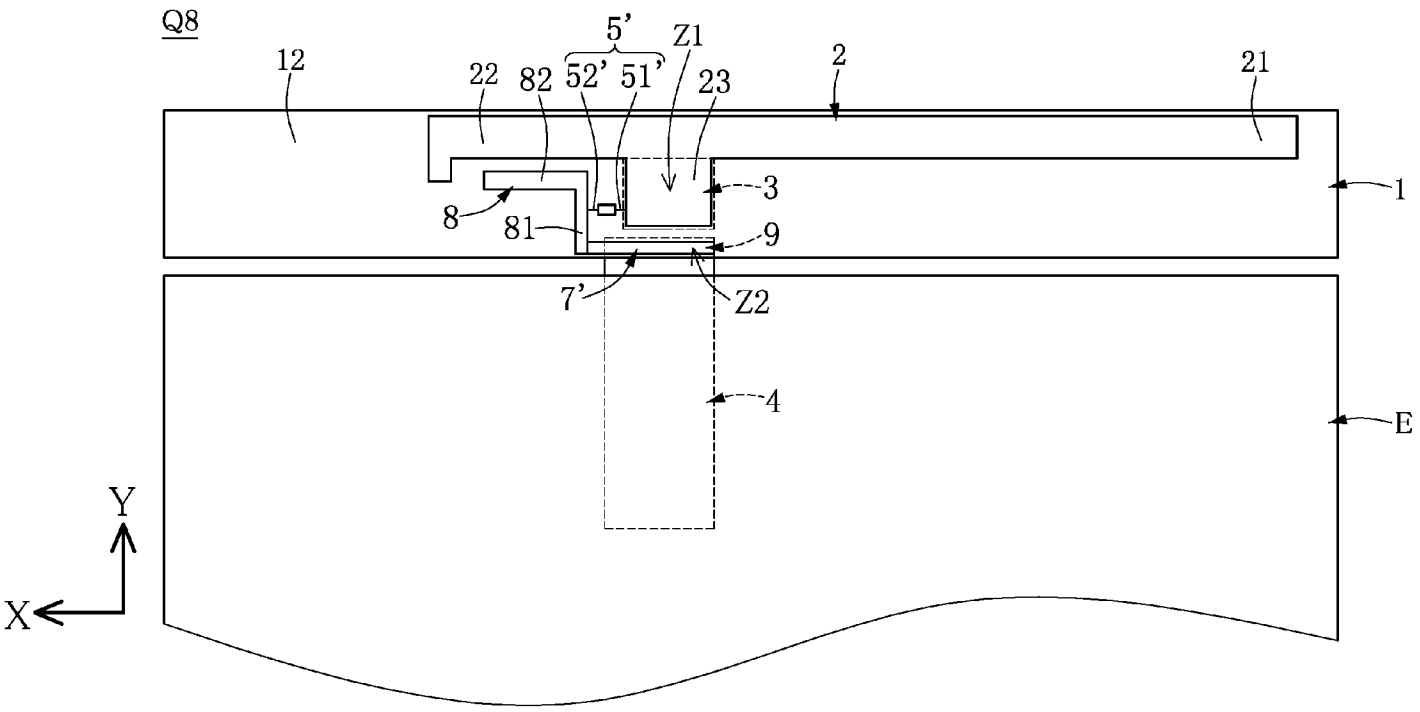
FIG. 12 is a bottom-perspective schematic view of the antenna structure of an eighth embodiment of the instant disclosure.

Reference is made to FIG. 11 and FIG. 12. Compared with FIG. 10, the main difference between the eighth embodiment and the seventh embodiment is that the antenna structure Q8 provided by the eighth embodiment further includes a grounding coupling element 9 separated from the coupling element 3. The parasitic element 8 and the conducting element 5' can be disposed on a surface on which the radiation element 2 is disposed. The structures of the other elements in the eighth embodiment are similar to that of the previous embodiments and are not reiterated herein.

As shown in FIG. 11 and FIG. 12, the grounding coupling element 9, the bridging element 7' and the parasitic element 8 can be disposed on the substrate 1. The grounding coupling element 9, the bridging element 7' are separated from each other and coupling to each other. The grounding coupling element 9 is coupled with the grounding element 4, and the bridging element 7' can be coupled with the parasitic element 8. Therefore, the overlap area of the grounding coupling element 9 and the bridging element 7' can be defined as a second coupling area Z2, and the area of the second coupling area Z2 is proportional to the bandwidth of the operation frequency generated by the antenna structure Q8. In addition, the area of the second coupling area Z2 is inversely proportional to the central frequency of the operation band generated by the antenna structure Q8.

As shown in FIG. 11 and FIG. 12, the coupling element 3 and the grounding coupling element 9 can be disposed on the first surface 11, and the grounding coupling element 9 can be coupled with the grounding element 4. In addition, the radiation element 2, the parasitic element 8, the conducting element 5' and the bridging element 7' can be disposed on the second surface 12. One end (the second end 52') of the conducting element 5' can be coupled with the parasitic element 8, and the other end (the first end 51') of the conducting element 5' can be coupled with the coupling portion 23 of the radiation element 2. The conducting element 5' can be indirectly connected to the grounding element 4. Therefore, the signal fed by the feeding element 6 can form a loop by transmitting through the first coupling area Z1, the conducting element 5', the parasitic element 8, the second coupling area Z2 between the bridging element 7' and the grounding coupling element 9 and the grounding element 4 sequentially. It should be noted that in the present embodiment, the conducting element 5' can be an inductor, a metal conductive line or other electrical conductors disposed between the coupling portion 23 and the first parasitic portion 81.

Ninth Embodiment

Figure 13:
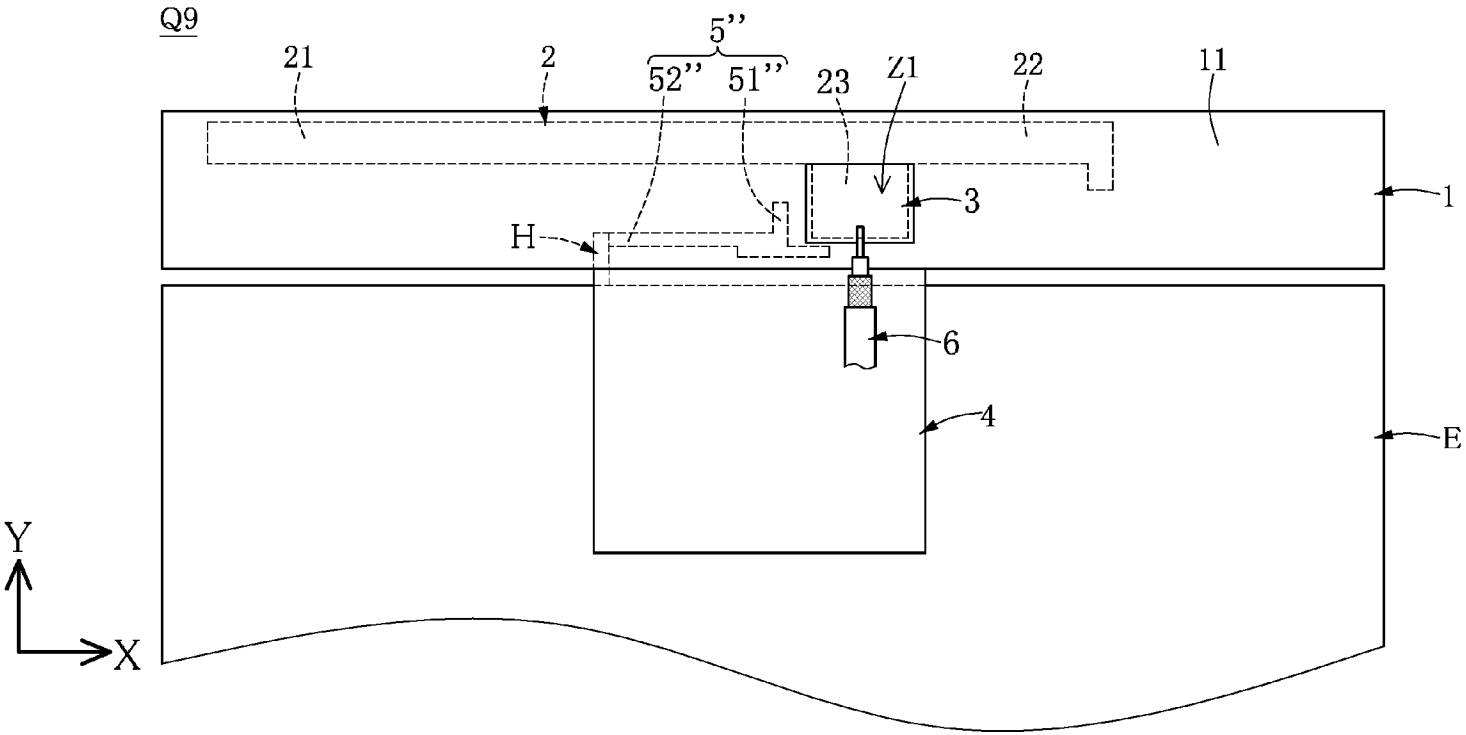
FIG. 13 is a top-perspective schematic view of the antenna structure of a ninth embodiment of the instant disclosure.
Figure 14:
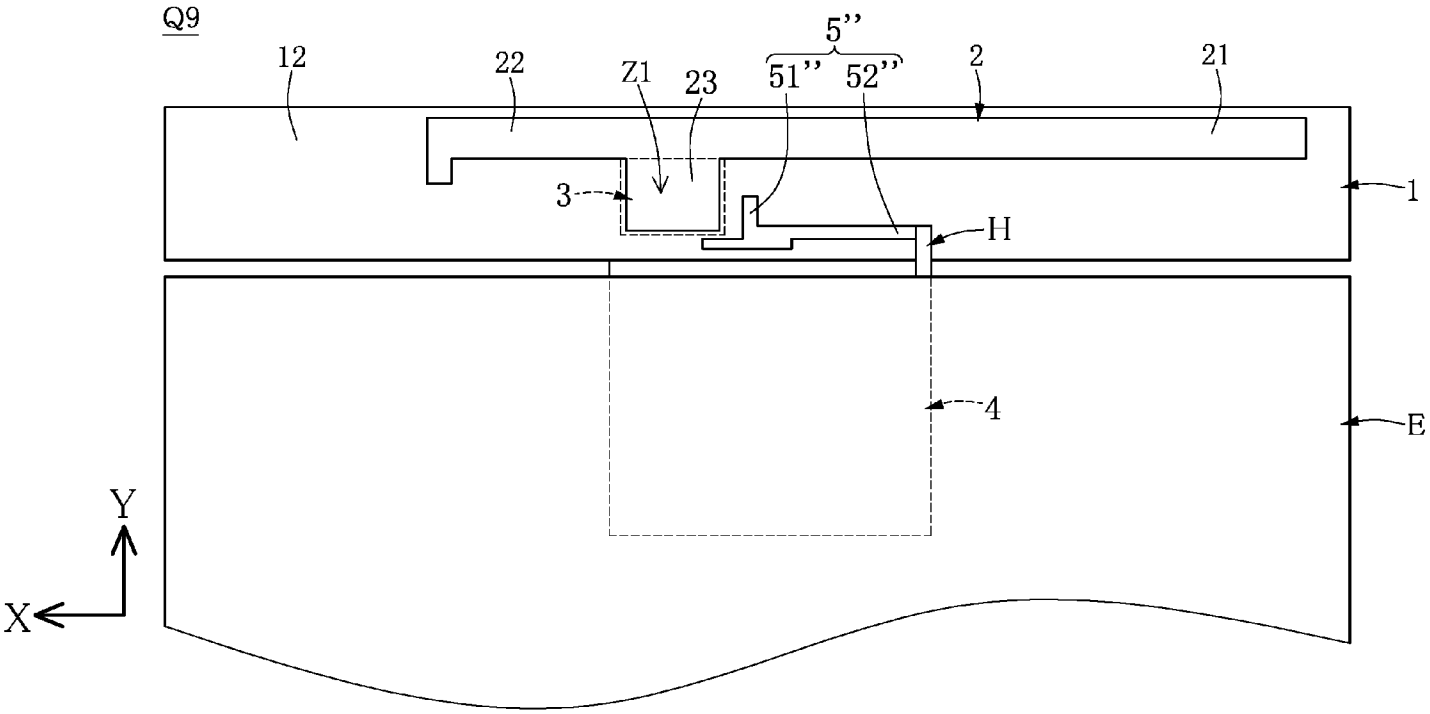
FIG. 14 is a bottom-perspective schematic view of the antenna structure of a ninth embodiment of the instant disclosure.

Reference is made to FIG. 13 and FIG. 14. Compared FIG. 13 with FIG. 1, the main difference between the ninth embodiment and the first embodiment is that the conducting element 5" in the antenna structure Q9 is separated from the coupling portion 23 of the radiation element 2 and coupling to the coupling portion 23 of the radiation element 2. The signal of the feeding element 6 can be transmitted to the grounding element 4 by the coupling relationship between the coupling portion 23 and the conducting element 5". However, the instant disclosure is not limited thereto. The structures of the other elements in the ninth embodiment are similar to that of the previous embodiments and are not reiterated herein.

Reference is made to FIG. 13 and FIG. 14. Specifically, in the ninth embodiment, the coupling element 3 can be disposed on the first surface 11, and the radiation element 2 and the conducting element 5" can be disposed on the second surface 12. The conducting element 5" can have a first portion 51" separated from and coupling to the coupling portion 23 and a second portion 52" coupled with the grounding element 4. It should be noted that since the conducting element 5" is disposed on the second surface 12, by forming a via V (not shown in FIG. 13 and FIG. 14, shown in FIG. 17 and FIG. 18) penetrating the first surface 11 and the second surface 12, the conducting element 5" can be electrically connected to the grounding element 4 through the conductor (not shown) in the via V. In addition, in an embodiment, the conducting element 5" can be electrically connected to the grounding element 4 by bending the conducting element 5". It should be noted that disposing a conductor in the via V for enabling the electrical connection between two opposite surfaces is a technique well-known to those skilled in the art and is not described in details herein.

Preferably, as shown in FIG. 13 and FIG. 14, an inductance unit H can be further included in the present embodiment. The inductance unit H can be disposed on the conduction path of the conducting element 5" and on the first surface 11 or the second surface 12. In the embodiments of the instant disclosure, the inductance unit H is located between the coupling portion 23 and the grounding element 4. For example, as shown in FIG. 13 and FIG. 14, the inductance unit H is disposed between the conducting element 5" and the grounding element 4. However, the instant disclosure is not limited thereto. In other implementations, as long as the inductance unit H is located on the path between the conducting element 5" and the grounding element 4, the details thereof can be adjusted. It should be noted that when the path of the conducting element 5" increases, an inductance unit H having smaller inductance value can be used.

As shown in FIG. 13 and FIG. 14, the coupling degree of between the coupling portion 23 of the radiation member 2 and the first portion 51" of the conducting element 5" (the coupling amount, i.e., the coupling area or interval between the first portion 51" and the coupling portion 23) is proportional to the degree of a impedance value approximating a predetermined impedance value, the impedance value is corresponded to a central frequency of an operation band generated by the antenna structure Q9. In other words, when the coupling area between the radiation portion 23 of the radiation element 2 and the first portion 51" of the conducting element 5" increases or the interval between the radiation portion 23 of the radiation element 2 and the first portion 51" of the conducting element 5" decreases, the coupling degree (coupling amount) between the radiation portion 23 of the radiation element 2 and the first portion 51" of the conducting element 5" increases. Meanwhile, the impedance value corresponding to the central frequency of the antenna structure Q9 approaches the predetermined impedance value. In contrast thereto, when the coupling degree between the radiation portion 23 of the radiation element 2 and the first portion 51" of the conducting element 5" decreases, the impedance value corresponded to the central frequency of the antenna structure Q9 increases.

Tenth Embodiment

Figure 15:
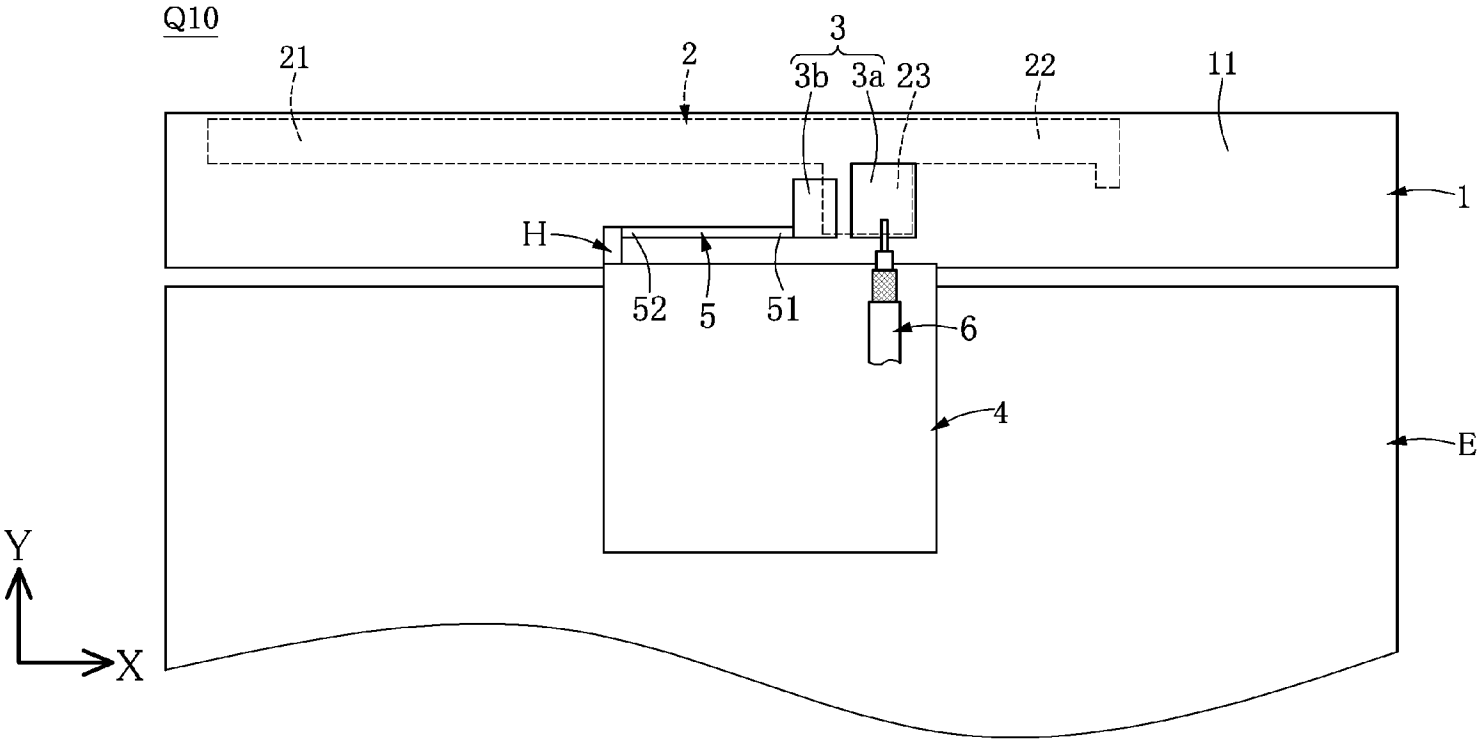
FIG. 15 is a top-perspective schematic view of the antenna structure of a tenth embodiment of the instant disclosure.
Figure 16:
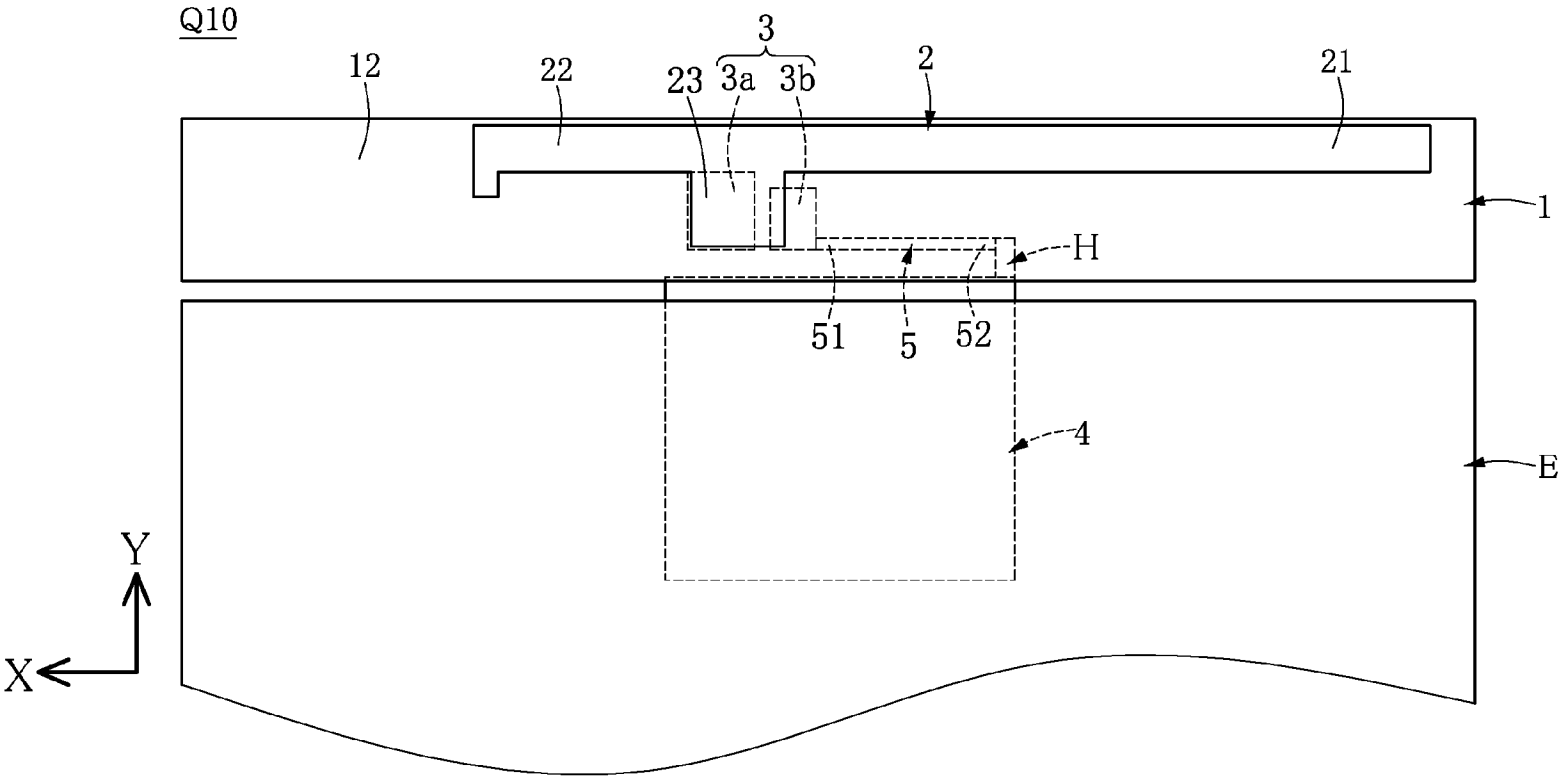
FIG. 16 is a bottom-perspective schematic view of the antenna structure of a tenth embodiment of the instant disclosure.

Reference is made to FIG. 15 and FIG. 16. Compared FIG. 15 with FIG. 1, the main difference between the tenth embodiment and the first embodiment is that the coupling element 3 in the antenna structure Q10 provided by the tenth embodiment has a first coupling area 3*a* and a second coupling area 3*b*. The first coupling area 3*a* and the second coupling area 3*b* are separated from each other and couple with each other. The coupling portion 23 of the radiation element 2 is at least separated from and couple with the first coupling area 3*a*. The feeding element 6 is coupled between the first coupling area 3*a* and the grounding element 4. In addition, one end of the conducting element 5 (the first end 51) can be coupled with the second coupling area 3*b*, and the other end of the conducting element 5 (the second end 52) can be coupled with the grounding element 4. In other words, the first coupling area 3*a* and the second coupling area 3*b* can transmit signal to the conducting element 5 by coupling. The structures of the other elements in the tenth embodiment are similar to that of the previous embodiments and are not reiterated herein. In addition, in other embodiments, the coupling portion 23 of the radiation member 2 can couple with the first coupling area 3*a* and the second coupling area 3*b* at the same time, or can couple to only one of the first coupling area 3*a* and the second coupling area 3*b*. The instant disclosure is not limited thereto.

Reference is made to FIG. 15 and FIG. 16. For example, the conducting element 5 provided in the tenth embodiment can be an inductance element. In addition, when the conducting element 5 is a metal line or other conductors, the antenna structure Q10 can further include an inductance unit H disposed on the conduction path of the conducting element 5. Therefore, one end of the conducting element 5 (the first end 51) can be coupled to the second coupling area 3*b*, and the other end of the conducting element 5 (the second end 52) can be coupled with the inductance unit H. The inductance unit H is coupled with the ground element 4. It should be noted that the location and effectiveness of the inductance unit H are similar to that of the previous embodiments and are not reiterated herein.

It should be noted that as shown in FIG. 15 and FIG. 16, the coupling degree between the first coupling area 3*a* and the second coupling area 3*b* (the coupling amount, i.e., the coupling area or interval between the first coupling area 3*a* and the second coupling area 3*b*) is proportional to a degree of an impedance value corresponding to a center frequency of an operating band generated by the antenna structure Q10 approximating a predetermined impedance value. In other words, when the coupling area between the first coupling area 3*a* and the second coupling area 3*b* increases or the interval between the first coupling area 3*a* and the second coupling area 3*b* decreases, the coupling degree (the coupling amount) between the first coupling area 3*a* and the second coupling area 3*b* increases. Meanwhile, the impedance value corresponding to the central frequency of the antenna structure Q10 approaches the predetermined impedance value. In contrast thereto, when the coupling degree between the first coupling area 3*a* and the second coupling area 3*b* decreases, the impedance value corresponding to the central frequency of the antenna structure Q10 increases.

[Eleventh Embodiment]

Figure 17:
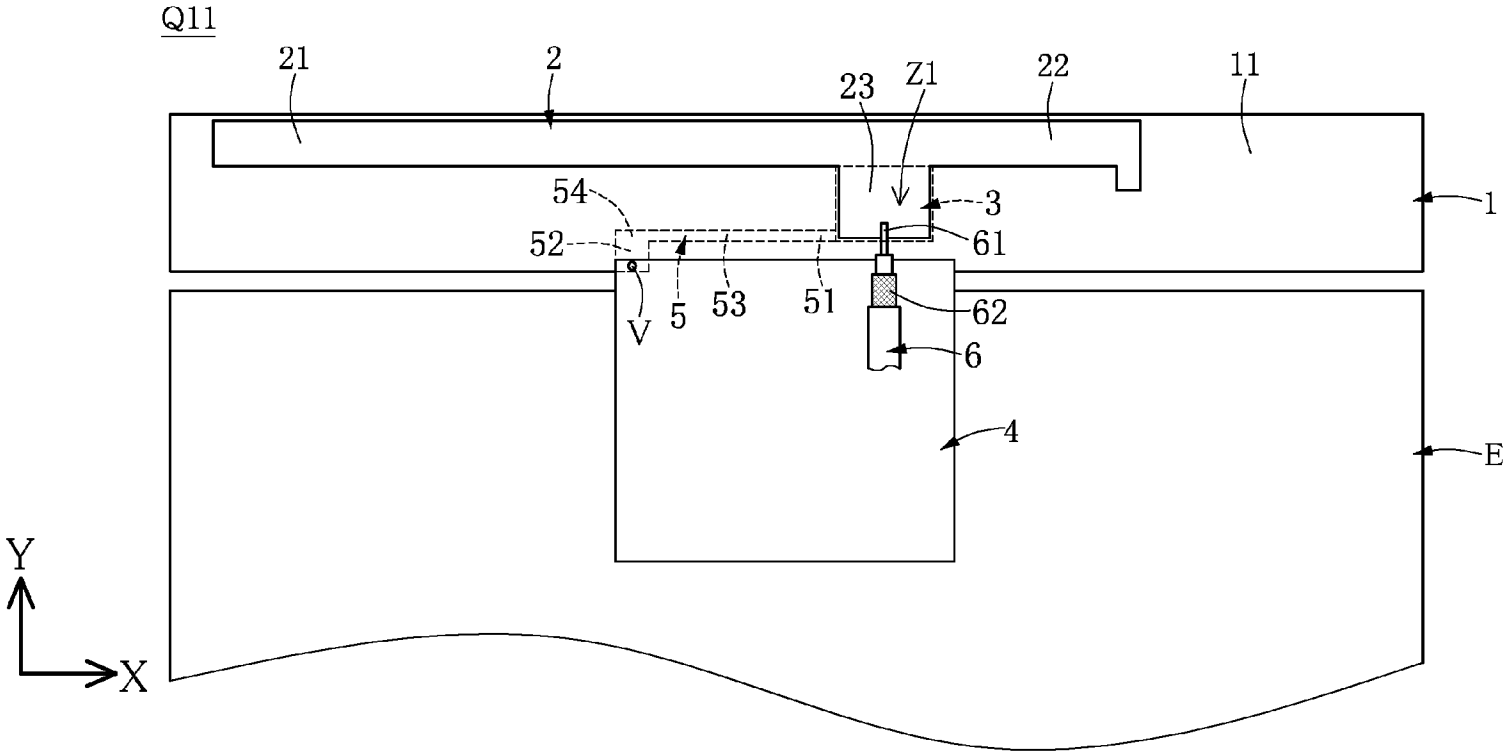
FIG. 17 is a top-perspective schematic view of the antenna structure of an eleventh embodiment of the instant disclosure.
Figure 18:
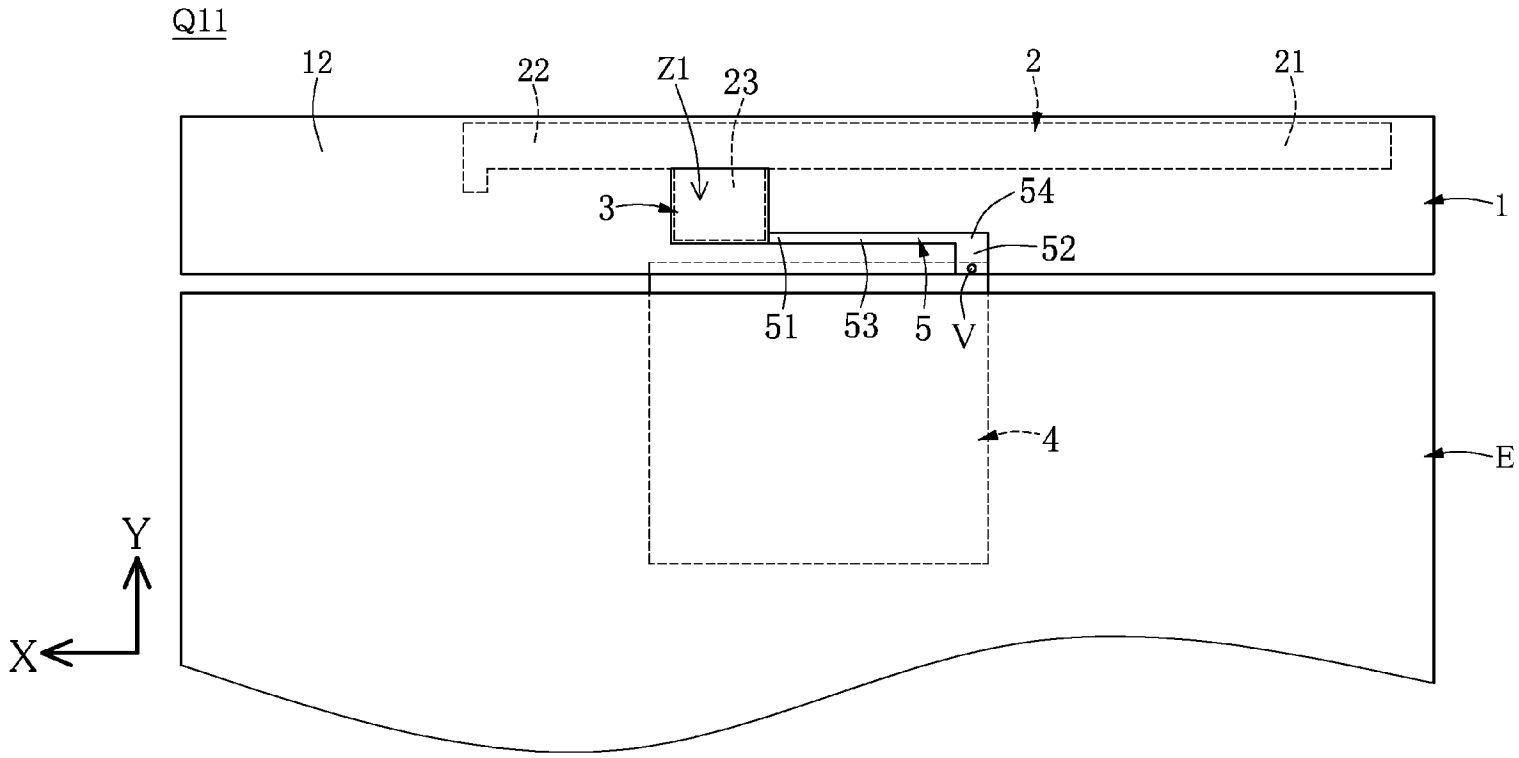
FIG. 18 is a bottom-perspective schematic view of the antenna structure of an eleventh embodiment of the instant disclosure.

Reference is now made to FIG. 17 and FIG. 18. Compared with FIG. 1, the main difference between the eleventh embodiment and the first embodiment is that the feeding element 6 of the eleventh embodiment is coupled between the coupling portion 23 and the grounding element 4. Specifically, as shown in FIG. 17 and FIG. 18, a signal can be fed into the coupling portion 23 through the feeding element 6, and the conducting element 5 can transmit the signal through the via V on the substrate 1 to the grounding element for changing the feeding type of the signal.

In the eleventh embodiment, the radiation element 2 can be disposed on the first surface 11 of the substrate 1, and the conducting element 5 and the coupling element 3 can be disposed on the second surface 12 of the substrate 1 for rendering the radiation element 2 and the grounding element 4 on a same plane. In addition, the feeding terminal 61 of the feeding element can be electrically connected to the coupling portion 23, and the grounding terminal 62 of the feeding element 6 can be electrically connected to the grounding element 4. Therefore, by forming the via V penetrating the first surface 11 and the second surface 12 on the metal conductor E or the substrate 1, the conducting element 5 is electrically connected to the grounding element 4 through the conductor in the via V. In addition, in other embodiments, the conducting element 5 can be electrically connected to the grounding element 4 by bending the conducting element 5. The structures of the other elements in the eleventh embodiment and the properties and application thereof are similar to that of the previous embodiments and are not reiterated herein.

Specifically, the design of disposing the feeding element 6 between the coupling portion 23 and the grounding element 4 and the signal transmission from the conducting element 5 to the grounding element 4 through the via V on the substrate 1 can be preferably applied in the first embodiment to the seventh embodiment (Q1-Q7), the ninth embodiment (Q9) and the tenth embodiment (Q10). However, the instant disclosure is not limited thereto. In other words, when the radiation element 2 and the grounding element 4 are disposed on a same plane and the feeding element 6 is coupled between the coupling portion 23 and the grounding element 4, the via V can be used to transmit the signal to the grounding element 4. It should be noted that the structure of the sixth embodiment described above when applying the design of the eleventh embodiment is described in the following twelfth embodiment.

Twelfth Embodiment

Figure 19:
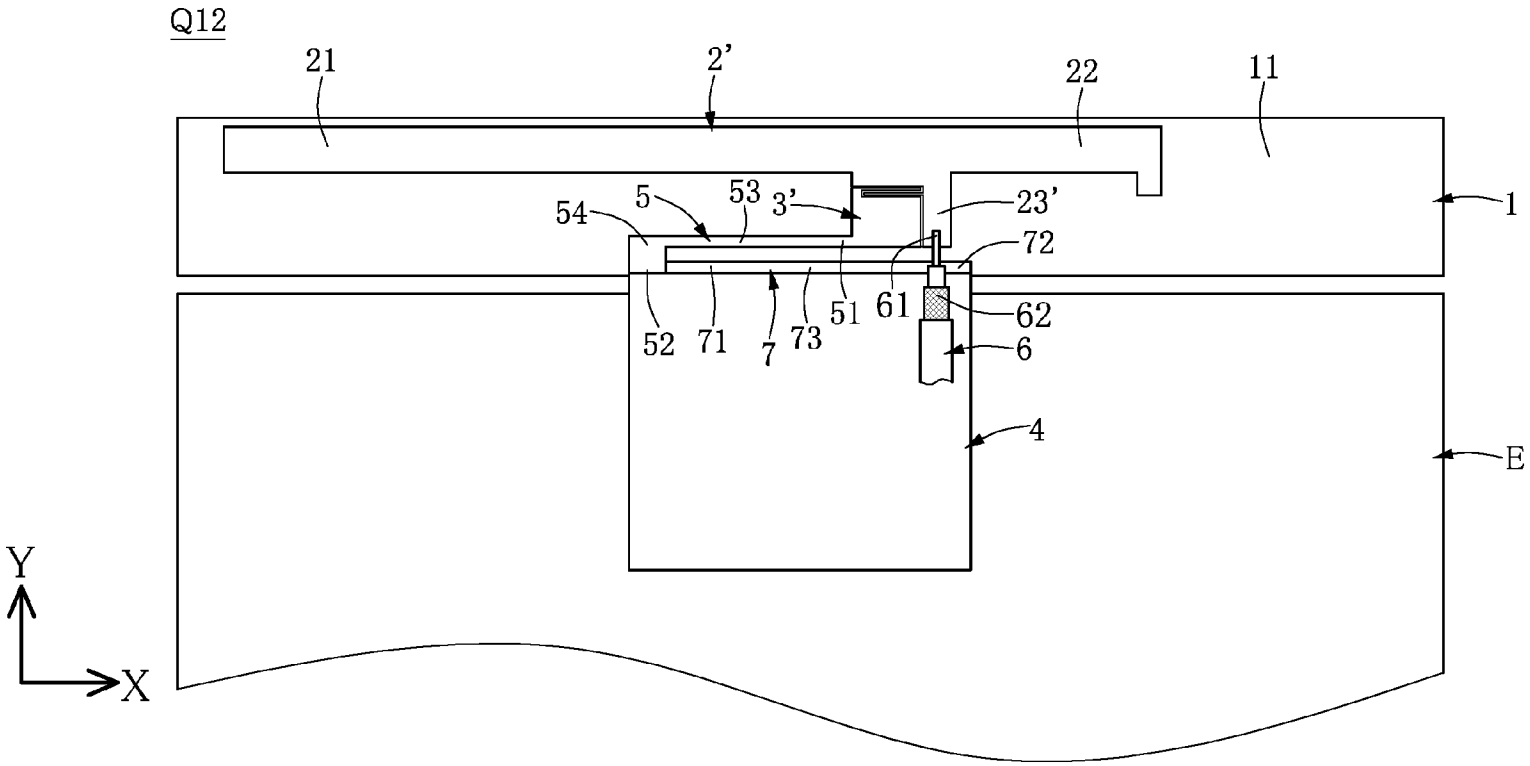
FIG. 19 is a top-perspective schematic view of the antenna structure of a twelfth embodiment of the instant disclosure.

Reference is now made to FIG. 19. Compared FIG. 19 with FIG. 8, the main difference between the twelfth embodiment and the sixth embodiment is that the feeding element 6 is coupled between the coupling portion 23 and the grounding element 4. Furthermore, as shown in FIG. 19, the feeding terminal 61 of the feeding element 6 can be electrically connected to the coupling portion 23' and the grounding terminal 62 of the feeding element 6 can be electrically connected to the grounding element 4. Therefore, the type of the signal feeding is changed. The structures of the other elements in the twelfth embodiment are similar to that of the previous embodiments and are not reiterated herein. In other words, the bridging element 7, the parasitic element 8, the inductance unit H, etc. are optional elements.

Thirteenth Embodiment

Figure 20:
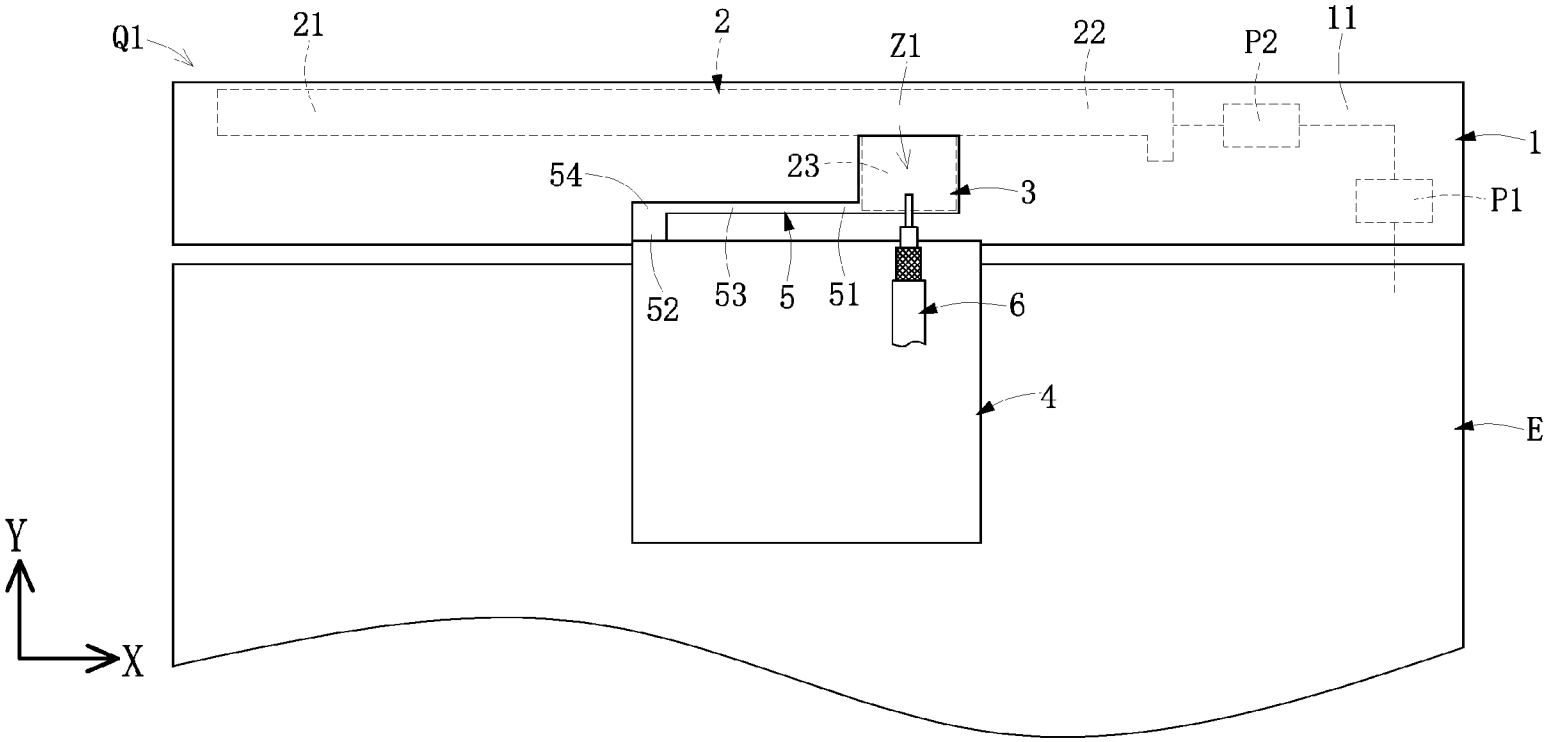
FIG. 20 is a top-perspective schematic view of the antenna system of a thirteenth embodiment of the instant disclosure.
Figure 21:
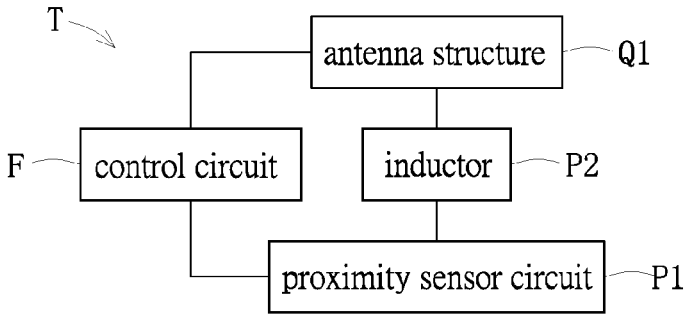
FIG. 21 is a block diagram of the antenna system of a thirteenth embodiment of the instant disclosure.

Reference is next made to FIG. 20 and FIG. 21. FIG. 20 is a top-perspective schematic view of the antenna system of the thirteen embodiment of the instant disclosure. FIG. 21 is a block diagram of the antenna system of the thirteen embodiment of the instant disclosure. Compared with FIG. 1, the main difference between the thirteen embodiment and the first embodiment is that the antenna system T provided by the thirteen embodiment can employ the antenna structures (Q1, Q2, Q3, Q4, Q5, Q6, Q7, Q8, Q9, Q10, Q11, Q12) provided by the previous embodiments in combination with a proximity sensor circuit P1 and an inductor P2. For convenience, the antenna structure in the antenna system T is exemplified as the antenna structure Q1 provided by the first embodiment. The antenna system T has a function of sensing if a human body is approaching the antenna system T by use of the proximity sensor circuit P1 and the inductor P2, thereby adjusting the emitting power of the antenna structure Q1. In addition, for example, the antenna system T can be used in a hybrid laptop or 2-in-1 laptop. However, the instant disclosure is not limited thereto.

Specifically, the inductor P2 can be electrically connected between the radiation element 2 and the proximity sensor circuit P1, and the proximity sensor circuit P1 can be electrically connected between the inductor P2 and the grounding element 4. In other words, the proximity sensor circuit P1 and the inductor P2 can be disposed on the substrate 1 and electrically connected between the radiation element 2 and the metal conductor E or between the radiation element 2 and the grounding element 4 for forming a conducting circuit. For example, the inductor P2 is a low-pass filter, and the proximity sensor circuit P1 is a capacitance value sensor. Based on the use of the capacitance value sensor and the low-pass filter, the radiation element 2 of the antenna structure Q1 can be used as a sensing electrode for the proximity sensor circuit P1 to detect capacitance value. In addition, for example, when the antenna system T is applied in a hybrid laptop, the metal conductor E can be the back cover structure of the laptop. However, the instant disclosure is not limited thereto. The figure of the instant disclosure shows that the proximity sensor circuit P1 is indirectly electrically connected to the grounding element 4 through the metal conductor E. However, in other embodiments, the proximity sensor circuit P1 can directly be electrically connected to the grounding element 4 or other grounding circuits. The instant disclosure is not limited thereto.

For example, the proximity sensor circuit P1 and the inductor P2 can be electrically connected between the antenna structure Q1 and a control circuit, and the control circuit is electrically connected to the antenna structure Q1. Therefore, the control circuit can adjust the emission power of the antenna structure Q1 based on a signal detected by the proximity sensor circuit P1. In other words, the proximity sensor circuit P1 can be used to detect the parasitic capacitance value between the radiation element 2 and the metal conductor E, thereby judging the distance between objects (such as the leg of a user) and the proximity sensor circuit P1 based on the parasitic capacitance value. The electric circuit of the control circuit can be integrated into the proximity sensor circuit P1. However, the instant disclosure is not limited thereto.

The radiation element 2 of the antenna structure Q1 can be a sensor electrode or a sensor pad, and the control circuit can judge if the leg or other body parts of the user is adjacent to a predetermined detection range of the antenna structure Q based on the change of the capacitance value detected by the proximity sensor circuit P1. When the leg or other body parts of the user is in the predetermined detection range, the control circuit decreases the emission power of the antenna structure Q1 to prevent the SAR value from becoming too high. When the leg or other body parts of the user is outside of the predetermined detection range, the control circuit increases the emission power of the antenna structure Q1 to maintain the overall efficiency of the antenna structure Q1. It should be noted that the inductor P2 mentioned in the embodiments of the instant disclosure is not a proximity sensor circuit P1 (P-sensor).

Fourteenth Embodiment

Figure 22:
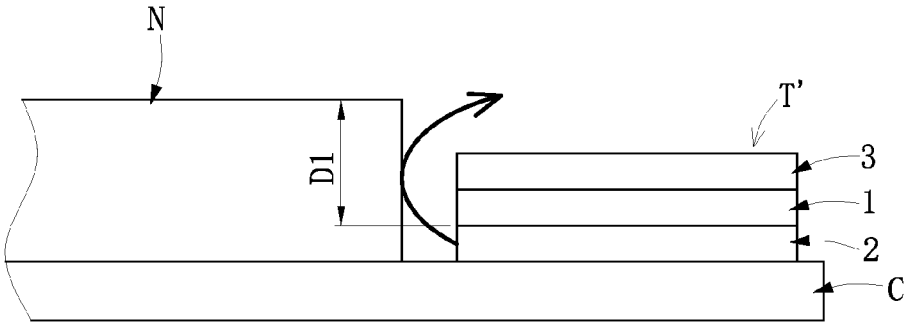
FIG. 22 is a schematic view of an inner structure of the antenna system of a fourteenth embodiment of the instant disclosure.

Reference is made to FIG. 22, which is a schematic view of the inner structure of the antenna system of the fourteenth embodiment of the instant disclosure. The details of the arrangements of the antenna structures (Q1, Q2, Q3, Q4, Q5, Q6, Q7, Q8, Q9, Q10, Q11, Q12) or the antenna system T provided by the previous embodiments in an electrical device are described herein. Specifically, the electrical device (not numbered) can include a display panel, a cover and the antenna system T' provided by the previous embodiment (or the antenna structures (Q1, Q2, Q3, Q4, Q5, Q6, Q7, Q8, Q9, Q10, Q11, Q12)).

As shown in FIG. 22, the display panel and the antenna structure Q1 are disposed on the cover, and the antenna structure Q1 is disposed at a side of the display panel. The radiation element 2, the substrate 1 and the coupling element 3 are sequentially stacked on the cover, in which the radiation element 2 is closer to the cover than the coupling element 3. Therefore, since the radiation element 2 is disposed on a more outer position of the electrical device and serves as the sensing electrode of the proximity sensor circuit P1, the sensing distance of the antenna structure Q1 is relatively large. However, since the first distance D1 between the upper surface of the display panel and the upper surface of the radiation element 2 is relatively far, the radiation element 2 may be blocked by the display panel so that the antenna efficiency may be reduced.

Fifteenth Embodiment

Figure 23:
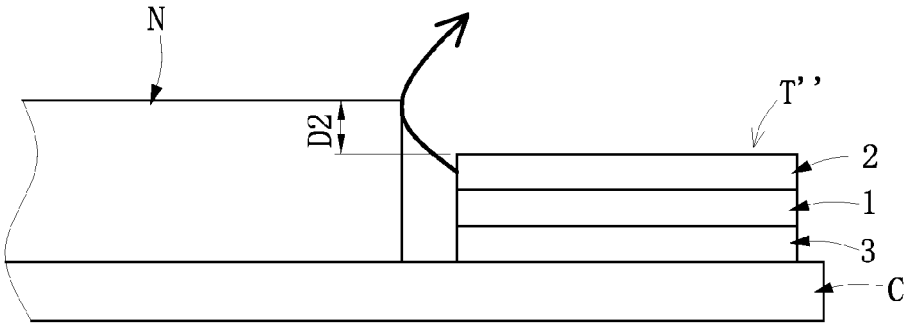
FIG. 23 is a schematic view of an inner structure of the antenna system of a fifteenth embodiment of the instant disclosure.

Reference is made to FIG. 23, which is a schematic view of the inner structure of the antenna system of the fifteenth embodiment of the instant disclosure. Compared with FIG. 22, the main difference between the fifteenth embodiment and the fourteenth embodiment is that the arrangements of the coupling element 3, the substrate 1 and the radiation element 2 the antenna system T" (or the antenna structures (Q1, Q2, Q3, Q4, Q5, Q6, Q7, Q8, Q9, Q10, Q11, Q12) of the fifteenth embodiment are different from those of the fourteenth embodiment. In the fifteenth embodiment, the coupling element 3, the substrate 1 and the radiation element 2 sequentially stack on the cover in which the coupling element 3 is closer to the cover than the radiation element 2. Therefore, compared with the fourteenth embodiment, the radiation element 2 of the fifteenth embodiment is disposed in a position deeper inside the electronic device and hence, the sensing distance of the antenna structure is smaller. However, since the distance between upper surface of the display panel and the upper surface of the radiation element 2, i.e., the second distance D2, is relatively small, the radiation element 2 is not likely to be blocked by the display panel, thereby increasing the antenna efficiency. In other words, by disposing the radiation elements 2 of the antenna structures of the first embodiment to the fifteenth embodiment at a location closer to the inner center of the electronic structure, the antenna efficiency can be improved.

Effect of the Embodiments

In sum, the advantages of the instant disclosure is that the antenna systems (T, T', T") and the antenna structures (Q1, Q2, Q3, Q4, Q5, Q6, Q7, Q8, Q9, Q10, Q11, Q12) thereof provided by the embodiments of the instant disclosure can increase the performance of the antennas while avoiding the excessively high SAR value when the antenna is near the user. In addition, the conducting elements (5, 5'), the bridging elements (7, 7') and the parasitic element 8 of the antenna structures (Q1, Q2, Q3, Q4, Q5, Q6, Q7, Q8, Q9, Q10, Q11, Q12) described in the previous embodiment can be used in different embodiments. In addition, the coupling manner of the coupling portions (23, 23') and the coupling elements (3, 3') (disposed on a same surface or on different surfaces) can be selectively applied in different embodiments. Therefore, the elements described above can be combined in different manners to adjust the required properties of the antenna.

The above-mentioned descriptions represent merely the exemplary embodiment of the present disclosure, without any intention to limit the scope of the instant disclosure thereto. Various equivalent changes, alterations or modifications based on the claims of the instant disclosure are all consequently viewed as being embraced by the scope of the instant disclosure.

What is claimed is:

1. An antenna structure, comprising:

a substrate;

a radiation element disposed on the substrate, the radiation element including a first radiation portion for providing a first operating band, a second radiation portion for providing a second operating band and a coupling portion connected between the first radiation portion and the second radiation portion;

a coupling element disposed on the substrate, the coupling element and the coupling portion being separated from each other and coupling to each other;

a grounding element separated from the coupling portion of the radiation element;

a feeding element coupled between the coupling element and the grounding element for feeding a signal; and a conducting element coupled between the coupling element and the grounding element for transmitting the signal to the grounding element, wherein the coupling element and the coupling portion are not physically connected with each other.

2. The antenna structure according to claim 1, wherein a first coupling region is formed by the coupling element and the coupling portion overlap with each other, and an area of the first coupling region is proportional to a bandwidth of an operating band generated by the antenna structure.

3. The antenna structure according to claim 1, wherein a length of the conducting element extending from the coupling element to the grounding element being defined as an extension length, the extension length of the conducting element being proportional to a bandwidth of an operating band generated by the antenna structure.

4. The antenna structure according to claim 1, wherein the conducting element is an inductor disposed between the coupling element and the grounding element, the inductor providing an inductance value for adjusting a bandwidth of an operating band generated by the antenna structure, the inductance value being proportional to the bandwidth of the operating band generated by the antenna structure.

5. The antenna structure according to claim 1, further comprising: a parasitic element disposed on the substrate, the parasitic element being coupled with the grounding element and being not overlapped with the second radiation portion, the parasitic element having a first parasitic portion coupled with the grounding element and a second parasitic portion bending and extending away from the coupling element, the second parasitic portion of the parasitic element and the second radiation portion having a predetermined slit therebetween.

6. The antenna structure according to claim 1, wherein the substrate includes a first surface and a second surface opposite to the first surface, and the coupling element is disposed on the first surface and the radiation element is disposed on the second surface.

7. The antenna structure according to claim 1, wherein the substrate includes a first surface and a second surface opposite to the first surface, and the coupling element and the radiation element are disposed on the first surface, the coupling element and the coupling portion having a coupling gap therebetween, the coupling gap and a coupling amount between the coupling element and the coupling portion adjusting a bandwidth of an operating band generated by the antenna structure and a center frequency of the operating band.

8. The antenna structure according to claim 1, further including a parasitic element disposed on the substrate, wherein an end of the conducting element is coupled with the parasitic element, and the other end of the conducting element is coupled with the coupling element, one end of the parasitic element being coupled with the grounding element.

9. The antenna structure according to claim 8, wherein the parasitic element has a first parasitic portion coupled with the grounding portion and a second parasitic portion bended from the first parasitic portion and extending away from the coupling element, wherein the second parasitic portion of the parasitic element and the second radiation element have a predetermined silt therebetween.

10. The antenna structure according to claim 9, wherein the conducting element is an inductor disposed between the coupling element and the first parasitic portion.

11. The antenna structure according to claim 1, further including a grounding coupling element, a bridging element and a parasitic element, the grounding coupling element, the bridging element and the parasitic element being disposed on the substrate, wherein the grounding coupling element and the bridging element are separated from each other and coupling to each other, the grounding coupling element being coupled with the grounding element and the bridging element being coupled with the parasitic element.

12. The antenna structure according to claim 11, wherein one end of the conducting element is coupled to the parasitic element and the other end of the conducting element is coupled with the coupling portion.

13. The antenna structure according to claim 11, wherein the parasitic element has a first parasitic portion coupled with the bridging portion and a second parasitic portion bended from the first parasitic portion and extending away from the coupling element, wherein the second parasitic portion of the parasitic element and the second radiation element have a predetermined silt therebetween.

14. The antenna structure according to claim 1, wherein the conducting element has a first portion separated from and coupling to the coupling portion and a second portion coupled with the grounding element.

15. The antenna structure according to claim 14, further including an inductance unit disposed on a conducting path of the conducting element.

16. The antenna structure according to claim 1, wherein the coupling element has a first coupling area and a second coupling area, the feeding element is coupled between the first coupling area and the grounding element, and the first coupling area and the second coupling area are separated from and coupling to each other.

17. The antenna structure according to claim 16, wherein one end of the conducting element is coupled with the second coupling area and the other end of the conducting element is coupled with the grounding element.

18. The antenna structure according to claim 16, further including an inductance unit disposed on a path of the conducting element.

19. An antenna structure, including:

a substrate;

a radiation element disposed on the substrate, the radiation element including a first radiation portion for providing a first operation band, a second radiation portion for providing a second operation band and a coupling portion connected between the first radiation portion and the second radiation portion;

a coupling element disposed on the substrate, the coupling element and the coupling portion being separated from each other and coupling to each other;

a grounding element separated from the coupling portion of the radiation element;

a feeding element coupled between the coupling portion and the grounding element, for feeding a signal; and a conducting element coupled between the coupling element and the grounding element for transmitting the signal to the grounding element, wherein the coupling element and the coupling portion are not physically connected with each other.

20. An antenna system, comprising:

an antenna structure including:

a substrate;

a radiation element disposed on the substrate, the radiation element including a first radiation portion for providing a first operating band, a second radiation portion for providing a second operating band and a coupling portion connected between the first radiation portion and the second radiation portion;

a coupling element disposed on the substrate, the coupling element and the coupling portion being separated from each other and coupling to each other;

a grounding element separated from the coupling portion of the radiation element;

a feeding element coupled between the coupling element and the grounding element, for feeding a signal; and a conducting element coupled between the coupling element and the grounding element for transmitting the signal to the grounding element;

a proximity sensor circuit; and an inductor coupled between the radiation element and the proximity sensor circuit;

wherein the radiation element is a sensing electrode and the proximity sensor circuit detects a capacitance value through the sensing electrode, wherein the coupling element and the coupling portion are not physically connected with each other.

21. The antenna system according to claim 20, wherein the radiation element, the substrate and the coupling element are sequentially stacked on a cover, and the radiation element is closer to the cover than the coupling element.

22. The antenna system according to claim 20, wherein the coupling element, the substrate and the radiation element are sequentially stacked on a cover, and the coupling element is closer to the cover than the radiation element.

23. An antenna system, including:

an antenna structure including:

a substrate;

a radiation element disposed on the substrate, the radiation element includes a first radiation portion for providing a first operation band, a second radiation element for providing a second operation band and a coupling portion connected between the first radiation portion and the second radiation portion;

a coupling element disposed on the substrate, the coupling element and the coupling portion being separated from each other and coupling to each other;

a grounding element separated from the coupling portion of the radiation element;

a feeding element coupled between the coupling portion and the grounding element, for feeding a signal; and a conducting element coupled between the coupling element and the grounding element for transmitting the signal to the grounding element;

a proximity sensor circuit; and an inductor coupled between the radiation element and the proximity circuit;

wherein the radiation element is a sensing electrode and the proximity sensor circuit detects a capacitance value through the sensing electrode, wherein the coupling element and the coupling portion are not physically connected with each other.

* * * * *